US009834002B2

(12) United States Patent
Araki et al.

(10) Patent No.: US 9,834,002 B2
(45) Date of Patent: Dec. 5, 2017

(54) LIQUID DISCHARGE APPARATUS, IMPRINT APPARATUS AND PART MANUFACTURING METHOD

(71) Applicant: CANON KABUSHIKI KAISHA, Tokyo (JP)

(72) Inventors: Yoshimasa Araki, Utsunomiya (JP); Yuichi Takahashi, Utsunomiya (JP); Tsuyoshi Arai, Utsunomiya (JP); Yutaka Mita, Utsunomiya (JP); Tohru Ishibashi, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/078,064

(22) Filed: Mar. 23, 2016

(65) Prior Publication Data

US 2016/0288521 A1 Oct. 6, 2016

(30) Foreign Application Priority Data

Apr. 3, 2015 (JP) ..... 2015-076993
Apr. 3, 2015 (JP) ..... 2015-076994

(51) Int. Cl.
*B41J 2/175* (2006.01)
*B41J 2/19* (2006.01)
*B41J 2/18* (2006.01)

(52) U.S. Cl.
CPC ..... *B41J 2/17556* (2013.01); *B41J 2/175* (2013.01); *B41J 2/17566* (2013.01);
(Continued)

(58) Field of Classification Search
CPC ..... B41J 2/17556; B41J 2/17566; B41J 2/18; B41J 2/175; B41J 2/17596; B41J 2/19
See application file for complete search history.

(56) References Cited

U.S. PATENT DOCUMENTS 5,367,328 A * 11/1994 Erickson ..... B41J 2/175 347/7
5,872,579 A 2/1999 Handa et al.
(Continued)

FOREIGN PATENT DOCUMENTS

CN 101352969 A 1/2009
JP H09-011496 A 1/1997
(Continued)

OTHER PUBLICATIONS

Tawanese Office Action dated Mar. 1, 2017 in Taiwan Application No. 105107419.
(Continued)

*Primary Examiner* — Justin Seo
(74) *Attorney, Agent, or Firm* — Fitzpatrick, Cella, Harper & Scinto

(57) ABSTRACT

A liquid discharge apparatus comprises a head including a discharge port surface, a first reservoir that stores the liquid to be supplied to the head, a flexible member, separating an inner space of the first reservoir into a first chamber that stores the liquid and a second chamber that stores an operation liquid, a second reservoir communicating with the second chamber, the second reservoir storing the operation liquid to be supplied to the second chamber, the second reservoir being disposed in such a manner that a liquid surface of the operation liquid stored in the second reservoir is positioned below the discharge port surface, and an adjustment unit that performs adjustment in such a manner that a position of the liquid surface of the operation liquid in the second reservoir falls within a predetermined range in a state where the second reservoir is opened to atmosphere.

12 Claims, 14 Drawing Sheets

(52) U.S. Cl.
CPC ..... *B41J 2/17596* (2013.01); *B41J 2/18* (2013.01); *B41J 2/19* (2013.01)

(56) References Cited

U.S. PATENT DOCUMENTS

| | | | | |
|---|---|---|---|---|
| 6,113,217 | A | 9/2000 | Araki et al. | |
| 7,588,311 | B2 | 9/2009 | Araki et al. | |
| 8,208,158 | B2 | 6/2012 | Ishinaga et al. | |
| 8,602,537 | B2 * | 12/2013 | Katoh | B41J 2/175 347/84 |
| 8,684,512 | B2 | 4/2014 | Nakazawa et al. | |
| 2003/0025773 | A1 * | 2/2003 | Koizumi | B41J 2/17509 347/85 |
| 2003/0067520 | A1 * | 4/2003 | Inoue | B41J 2/17503 347/86 |
| 2009/0027435 | A1 | 1/2009 | Katada | |
| 2009/0122093 | A1 | 5/2009 | Mutoh | |
| 2009/0295888 | A1 * | 12/2009 | Nitta | B41J 2/175 347/89 |
| 2010/0073444 | A1 | 3/2010 | Sato | |
| 2011/0164078 | A1 * | 7/2011 | Katoh | B41J 2/17509 347/6 |
| 2012/0189359 | A1 | 7/2012 | Kitakami et al. | |
| 2013/0002743 | A1 * | 1/2013 | Masunaga | B41J 2/175 347/7 |
| 2013/0135401 | A1 * | 5/2013 | Kobayashi | B41J 2/175 347/85 |
| 2013/0321501 | A1 * | 12/2013 | Igarashi | B41J 2/175 347/7 |
| 2015/0097900 | A1 | 4/2015 | Araki et al. | |

FOREIGN PATENT DOCUMENTS

| | | | |
|---|---|---|---|
| JP | 2001-063091 | A | 3/2001 |
| JP | 2006-192785 | | 7/2006 |
| JP | 2006-212845 | A | 8/2006 |
| JP | 2008-105360 | | 5/2008 |
| JP | 2008-105360 | A | 5/2008 |
| JP | 2009-126098 | A | 6/2009 |
| JP | 2009-234151 | A | 10/2009 |
| JP | 2010-137419 | A | 6/2010 |
| JP | 2010-264594 | A | 11/2010 |
| JP | 2014-019127 | A | 2/2014 |
| TW | 2014-38876 | A | 10/2014 |

OTHER PUBLICATIONS

Chinese Office Action issued Oct. 9, 2017 in corresponding Chinese Application No. 201610206780.4. (with whole English translation).

* cited by examiner

LIQUID DISCHARGE APPARATUS, IMPRINT APPARATUS AND PART MANUFACTURING METHOD

BACKGROUND OF THE INVENTION

Field of the Invention

The present invention relates to a liquid discharge apparatus including a liquid discharge head that discharges a liquid, an imprint apparatus and a part manufacturing method.

Description of the Related Art

A liquid discharge head including a liquid discharge head (hereinafter simply referred to as "head") provided with a discharge port (hereinafter referred to as "nozzle") for discharging liquid has been known. In recent years, such the liquid discharge apparatus has been used in various fields and, for example, for an ink jet recording apparatus and the like.

Generally, it is required to always maintain the pressure in the head to be a negative pressure (lower than an atmospheric pressure) in order to prevent liquid from leaking to the outside from the head (nozzle).

For example, in Japanese Patent Application Laid-Open No. 2008-105360, there is disclosed a configuration for dividing an inside of a subreservoir by a flexible member 203 into an ink chamber 204 and a buoyance force generating chamber 205 in order to maintain the pressure in the subreservoir 202 communicating with the head 201 to be a negative pressure as illustrated in FIG. 15. And, a float bag 206 having a small specific gravity is provided in the buoyance force generating chamber 205 while connected with the flexible member 203. The inside of the head 201 communicated with the inside of the ink chamber 204 is maintained in a state of negative pressure by a buoyance force of the floating bag 206 in the buoyance force generating chamber 205.

However, the ink jet recording apparatus disclosed in Japanese Patent Application Laid-Open No. 2008-105360 has following problems.

Namely, in the ink jet recording apparatus disclosed in Japanese Patent Application Laid-Open No. 2008-105360, the float bag 206 filled with gas is required to be attached to the flexible member 203 and sunk in the liquid in the buoyance force generating chamber 205, thereby making the configuration complex. Further, in this configuration, since the difference in density between gas and liquid is relatively large, the float bag 206 is rocked greatly when an impact is applied to a housing of the subreservoir 202. Therefore, the pressure in the ink chamber 204 connected with the float bag 206 or the pressure in the head 201 communicating with the ink chamber 204 also fluctuates easily.

SUMMARY OF THE INVENTION

It is an object of the present invention to provide a liquid discharge apparatus that is capable of maintaining a pressure in a head stably and further suppressing leakage of a liquid from the head.

It is another object of the present invention to provide a liquid discharge apparatus, comprising:

a head including a discharge port surface on which a discharge port is formed to discharge a liquid;

a first reservoir that stores the liquid to be supplied to the head;

a flexible member, separating an inner space of the first reservoir into a first chamber that stores the liquid and a second chamber that stores an operation liquid;

a second reservoir communicating with the second chamber, the second reservoir storing the operation liquid to be supplied to the second chamber, the second reservoir being disposed in such a manner that a liquid surface of the operation liquid stored in the second reservoir is positioned below the discharge port surface; and an adjustment unit that performs adjustment in such a manner that a position of the liquid surface of the operation liquid in the second reservoir falls within a predetermined range in a state where the second reservoir is opened to atmosphere.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

A first embodiment will be explained below with reference to FIGS. 1, 2, 3 and 4. It is noted that an ink jet recording apparatus (hereinafter referred to as a "discharge apparatus") will be explained as an example of the liquid discharge apparatus of the invention in the embodiment. Further, "ink" used in the discharge apparatus of the embodiment is an example constituting "liquid" used in the discharge apparatus of the invention. The liquid may include a photocurable liquid.

Figure 1:
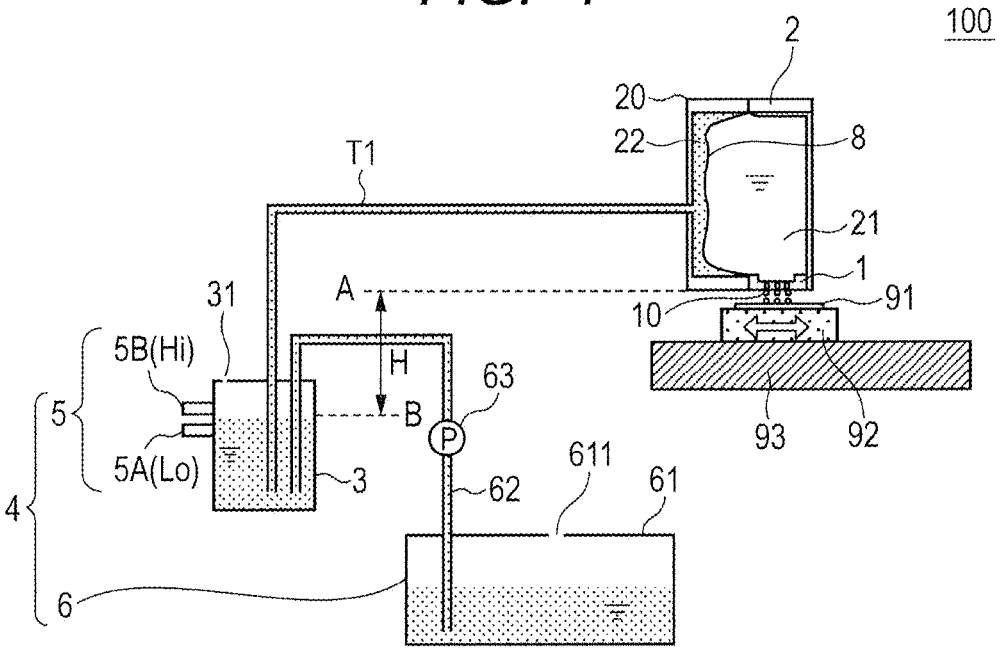
FIG. 1 is a conceptual view illustrating a liquid discharge apparatus according to a first embodiment of the present invention.

FIG. 1 is a conceptual view illustrating a discharge apparatus (liquid discharge apparatus) according to the embodiment.

As illustrated in FIG. 1, in the embodiment, the discharge apparatus 100 mainly includes a head 1 that discharges an ink (liquid), a first reservoir 2 that stores an ink and a second reservoir 3 that stores an operation liquid. Further, the discharge apparatus 100 includes conveyance means 92 that conveys a recording medium 91, a support portion 93 that supports the conveyance means 92 and the like. It is noted that the recording medium 91 is sucked and held on the conveyance means 92 by suction means (not illustrated).

The first reservoir 2 includes a rectangular parallelepiped housing 20 in a substantially sealed state and the head 1 is mounted on the bottom portion of the housing 20. The first reservoir 2 includes no atmosphere communicating opening. It is noted that the head 1 includes a discharge port surface 10 provided with a discharge port (not illustrated) at the bottom surface of the housing 20.

Inside the housing 20, a flexible film 8 (flexible member) having a flexible property is provided and the flexible film 8 separates the first reservoir 2 into a first chamber 21 and a second chamber 22. The first chamber 21 communicates with an inside of the head 1 provided at the bottom portion of the housing 20 and stores ink to be supplied to the head 1. On the other hand, the second chamber 22 communicates with the second reservoir 3 through a flow path T1 and stores an operation liquid to be supplied from the second reservoir 3.

It is noted that in the embodiment the first chamber 21 is filled with the ink and the second chamber 22 is filled with the operation liquid. The ink (liquid) in the first chamber 21 is what is sealed in advance.

On the other hand, the first reservoir 2 is configured to be removable with respect to the apparatus main body, and in a case where the ink (liquid) in the first reservoir 21 has been consumed, the first reservoir 2 can be replaced with a new one. Therefore, the first reservoir is not required to be provided with a replenishment mechanism (for example, an replenishment opening) for replenishing the first chamber 21 with the ink, and further there is little chance that the ink (liquid) in the first reservoir 2 is brought in contact with the outside, thereby preventing impurities from being mixed by the replenishment operation, too.

Further, in the embodiment as described below, in order to maintain a negative pressure in the head 1 more stably, a liquid having density substantially equal to the ink in the first chamber 21 is employed as the operation liquid in the second chamber 22. Furthermore, the operation liquid is an incompressible substance, and for example a liquid, such as water and the like and a gelled substance can be used as the operation liquid.

One end (lower end) of a flow path T1 connected with the second reservoir 3 is disposed not above a liquid surface of the operation liquid in the second reservoir 3. Further, the flow path T1 is configured to be filled with the operation liquid.

As illustrated in FIG. 1, an atmosphere communicating opening 31 is provided at an upper portion of the second reservoir 3 so that the second reservoir 3 is opened to atmosphere. To always maintain a state of negative pressure in the head 1 in the state where the second reservoir 3 is opened to atmosphere, a position B of the liquid surface of the operation liquid in the second reservoir 3 is disposed below a position A of the discharge port surface 10 of the head 1. Namely, a state of negative pressure in the head 1 is maintained by difference in height (head difference H) between the position A of the discharge port surface 10 and the position B of the liquid in the second reservoir 3 that stores the operation liquid in the discharge apparatus 100 of the embodiment.

Figure 2:
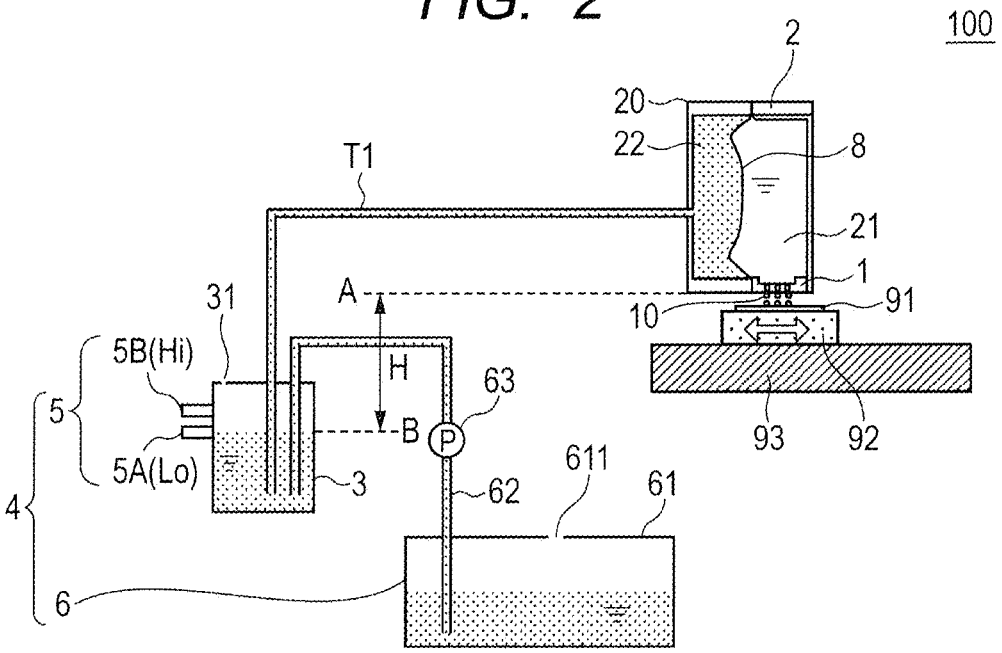
FIG. 2 is a conceptual view illustrating a state where ink in a first chamber of a first reservoir has been partially consumed in the first embodiment.

FIG. 2 is a conceptual view illustrating a state where ink has been partially consumed in the first chamber 21 of the first reservoir 2.

As illustrated in FIG. 2, when the ink in the first reservoir 2 (first chamber 21) is consumed, the operation liquid is supplied from the second reservoir 3 to the second chamber 22 by capillary force. Accordingly, the liquid surface of the operation liquid is lowered in the second reservoir 3 and the head difference H between the position A and the position B fluctuates.

In the embodiment, the discharge apparatus 100 includes adjustment unit 4 that makes adjustment in such a manner that a position of the liquid surface of the operation liquid falls within a predetermined range in the second reservoir 3, in order that a negative pressure is maintained to fall within a predetermined range in the head 1.

Specifically, the adjustment unit 4 includes liquid surface detection unit 5 that detects a position of the liquid surface in the second reservoir 3 and replenishment means 6 that replenishes the second reservoir 3 with the operation liquid.

The liquid surface detection unit 5 includes a lower limit position sensor 5A and an upper limit position sensor 5B in the second reservoir 3. The lower limit position sensor 5A and the upper limit position sensor 5B are disposed in such a manner that a pressure (negative pressure) falls within a predetermined range in the head 1. It is noted that the lower limit position sensor 5A and the upper limit position sensor 5B are an optical sensor.

The liquid surface is maintained to fall within a predetermined range (between a lower limit position to and an upper limit position Hi) in the second reservoir 3 so that a negative pressure is maintained to fall within the predetermined range in the head 1. In other words, unless the liquid surface is lowered to or below the lower limit position Lo in the second reservoir 3, the negative pressure in the head 1 does not exceed the upper limit of the predetermined range and there is little possibility that a meniscus is broken at the discharge port. On the other hand, unless the liquid surface is raised to or higher than the upper limit position Hi, the negative pressure in the head 1 does not exceed the lower limit of the predetermined range and there is little possibility that the ink is leaked from the head 1.

The replenishment means 6 includes a third reservoir 61 that stores the operation liquid and a flow path 62 connecting the second reservoir 3 with the third reservoir 61, and a pump 63 that is disposed at the flow path 62 and supplies the operation liquid (feeds liquid) to the second reservoir 3 from the third reservoir 61. It is noted that the third reservoir 61 includes an atmosphere communicating opening 611 similarly to the second reservoir 3 and is opened to atmosphere. Further, the pump 63 stopped except for during a replenishment operation for replenishing the second reservoir 3 with the operation liquid and the flow path 62 is also in a closed state.

Figure 3:
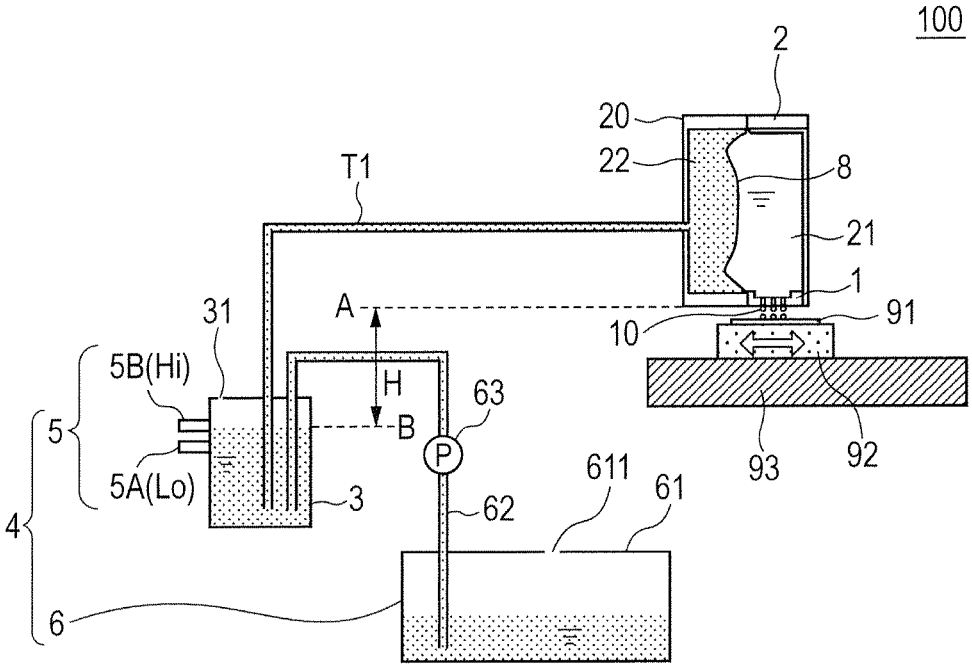
FIG. 3 is a conceptual view illustrating a state where operation liquid is replenished from a third reservoir to a second reservoir in the first embodiment.

FIG. 3 is a conceptual view illustrating a state of replenishing the second reservoir with the operation liquid from the third reservoir.

As illustrated in FIG. 3, when it is detected by the lower limit position sensor 5A that the liquid surface is lowered to the lower limit position Lo in the second reservoir 3, the replenish means 6 (pump 63) is operated to replenish the second reservoir with the operation liquid from the third reservoir and to recover the liquid surface to the lower limit position Lo or higher in the second reservoir. When it is detected that the liquid surface is reached to the upper limit position Hi in the second reservoir 3 again, the pump 63 is stopped. Therefore, the negative pressure can be maintained to fall within the predetermined range in the head 1.

Figure 4:
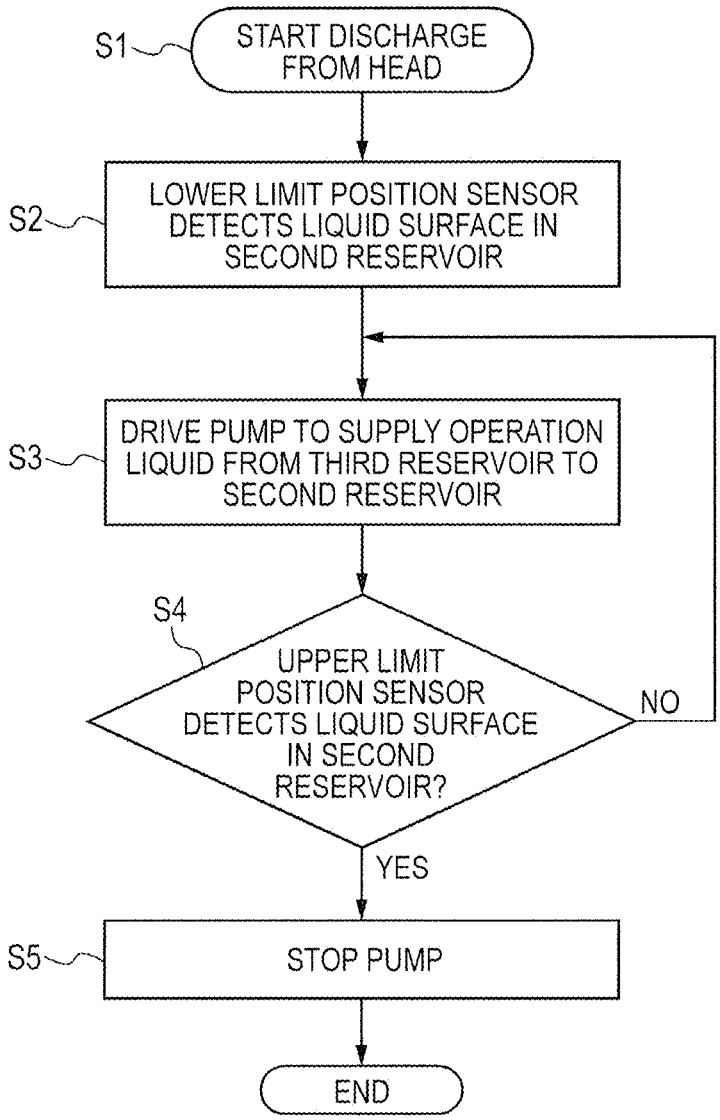
FIG. 4 is a flow chart illustrating control for replenishing the second reservoir with the operation liquid in the first embodiment.

FIG. 4 is a flow chart illustrating control for replenishing the second reservoir with the operation liquid from the third reservoir.

As illustrated in FIG. 4, when it is started that an ink is discharged from the head 1 (S1), replenishment control for replenishing the second reservoir with the operation liquid from the third reservoir is started based on detection results of the liquid surface detection units. Namely, simultaneously with the start of the discharge operation of the head 1, detection (monitoring) of the liquid surface in the second reservoir is started by the lower limit position sensor 5A installed in the second reservoir 3 (S2).

In step S2, when it is detected that the liquid surface is lowered to the lower limit position to in the second reservoir 3 by the lower limit position sensor 5A, the pump 63 is driven to feed the operation liquid from the third reservoir 61 to the second reservoir 3 (S3).

In step S3, when the operation liquid is supplied from the third reservoir 61 to the second reservoir 3, the liquid surface is raised in the second reservoir 3. When it is detected by the upper limit position sensor 5B that the liquid surface is raised to the upper limit position Hi in the second reservoir 3 (S4), the pump 63 is stopped (S5) and the replenish control is completed.

In step S4, it is noted that in a case where it is not yet detected by the upper limit position sensor 5B that the liquid surface is raised to the upper limit position Hi in the second reservoir 3, the procedure returns to step S3 to continue the liquid feeding operation by the pump 63.

As described above, in the embodiment, the liquid surface in the second reservoir 3 is made to be disposed below the discharge port surface 10 and further, the liquid surface in the second reservoir 3 is adjusted to fall within the predetermined range by the adjustment unit 4 so that a pressure in the head 1 can be controlled to fall within the predetermined range (negative pressure) stably. Therefore, ink leakage from the head 1 can be suppressed effectively. Further, ink can be discharged from the head 1 stably, too.

Specifically, in the embodiment, the first reservoir 2 (first chamber 21 and second chamber 22) is filled with the ink and the operation liquid having density close to each other so that vibration is suppressed effectively even if an impact is applied to the housing 20. Therefore, the pressure in the head 1 is hardly affected by vibration so that the inside of the head 1 can be maintained in a state of negative pressure stably.

It is noted that, in the embodiment, the operation liquid to be filled in the second chamber 22 is hardly affected by changes of surrounding temperature and pressure, compared with gas, in the embodiment. Accordingly, even if temperature or pressure fluctuates around the discharge apparatus 100, a pressure of the ink in the head 1 communicating with the first chamber 21 can be suppressed surely since the volume of operation liquid hardly fluctuates.

The detail on the flexible film 8 (flexible member) of the discharge apparatus 100 will be explained below.

As illustrated in FIG. 2, in the embodiment, the flexible film 8 is connected with each of a top face, a bottom face and two side faces of the housing, and is provided in the housing 20 along a direction (longitudinal direction) along a vertical direction. With this arrangement, the first chamber 21 and the second chamber 22 are formed dividedly into right and left in the housing 20.

When the ink in the first chamber 21 of the first reservoir 2 is consumed, the flexible film 8 is deformed, a volume of the first chamber 21 is decreased and a volume of the second chamber 22 is expanded. Accordingly, a volume of the operation liquid equal to that of the ink consumed in the first chamber 21 is supplied from the second reservoir 3 to the second chamber 22 through the flow path T1. In this occasion, the flexible film 8 is moved from left to right along a horizontal direction as illustrated in FIG. 2.

In other words, although a volume ratio between the ink and the operation liquid stored in the first reservoir 2 fluctuates by ink consumption, a gravity center of the first reservoir 2 substantially remains unchanged since the concentration of the operation liquid is substantially the same as that of the ink. Therefore, a stable negative pressure can be maintained in the head 1 positioned at a lower portion of the housing 20.

Specifically, in the embodiment, the flexible film 8 is disposed along the vertical direction, so that even if the operation liquid different in density from the ink is employed, the gravity center of the first reservoir 2 (liquid) is shifted by ink consumption in only the horizontal direction and is hardly shifted in a height direction.

In contrast, in a case where the flexible film 8 is disposed in the horizontal direction, the gravity center of the first reservoir 2 is shifted in the height direction as the ink is consumed. In a case where the flexible film 8 is disposed in the vertical direction, compared with the case where the flexible film 8 is disposed in the horizontal direction, a negative pressure is maintained stably in the head 1. Accordingly, an arrangement of the flexible film 8 (flexible member) in the vertical direction brings out effects that options for usable operation liquids are increased to facilitate design. For example, in a case where the operation liquid different in density from the liquid in the first reservoir 2 is used, operation liquid having density that falls within a range of 80% to 120% with respect to density of the liquid, may be used.

It is noted that the flexible film 8 does not necessarily have to be disposed along the vertical direction and may be disposed along a direction (longitudinal direction) along the vertical direction. Namely, even in a case where the flexible film 8 is disposed along the longitudinal direction, there is little shift amount of the gravity center of the first reservoir 2 by ink consumption in a height direction and a negative pressure can be maintained relatively stably in the head 1.

It is noted that in the embodiment, although the example in which the flexible film 8 is connected with the top face, the bottom face and the side faces of the housing, and the housing is formed to be divided into the first chamber 21 and the second chamber 22 has been explained, another arrangement configuration can be made. For example, the flexible film 8 may be installed in the housing 20 in such a manner that the first chamber 21 that stores the ink is substantially surrounded by the second chamber 22 that stores the operation liquid. Namely, the flexible film 8 may be installed in the housing 20 in such a manner that the first chamber 21 (space) that stores the ink is enclosed by the flexible film 8.

Further, it is preferable to select a member of the flexible film 8 used in the embodiment, which member is suitable for a characteristic of the ink (liquid stored in the first chamber) from the point of view of a liquid contact property and the like.

In the embodiment, although the ink jet recording apparatus that discharges the ink has been explained as an example of the liquid discharge apparatus, the invention may be properly modified and applied to, a for example, a liquid discharge apparatus that discharges a liquid, such as a conductive liquid, a UV curable liquid or the like.

Although in the embodiment, the configuration that the head 1 is mounted on and integrated with the lower portion of the housing 20 of the first reservoir 2 has been explained, the head 1 and the first reservoir 2 may be separately configured and the head 1 and the first reservoir 2 (first chamber 21) may be connected with each other by a connection tube.

Although, in the embodiment, the first reservoir (second chamber 22) is connected with the second reservoir 3 through the flow path T1, the first reservoir 2 and the second reservoir 3 may be configured to be separatable (removal) from each other by provision of a joint portion at the flow path T1.

Although in the embodiment, the volume of the housing 20 is made 500 ml, an initial amount of the ink in the first chamber 21 is made approximately 400 ml, and an initial amount of the ink in the second chamber 22 is made approximately 100 ml, they may be changed properly.

For example, it may be set that the volume of the housing 20 is made 400 ml, the initial amount of ink in the first chamber 21 is also made approximately 400 ml, and the operation liquid is made a minimum value that is close to 0 in an initial state. Namely, in a case where mixing of air is negligible, the operation liquid may not be filled in the second chamber 22 in the initial state.

In the embodiment, the first reservoir 2 (head 1) is mounted on a carriage (not illustrated), and the ink is discharged together with the movement of the carriage to perform recording operation. Even in a case where the first reservoir 2 is moving, the inner space of the first reservoir 2 is filled with the ink and the operation liquid, so that rocking movement of the flexible film 8 is suppressed. Therefore, it is unlikely that a pressure fluctuation occurs in the head 1 and ink leakage from the head 1 is reduced.

Although, in the embodiment, the optical sensors are utilized as the liquid surface detection unit 5, for example, the liquid surface detection unit 5 may be configured to include an electrode pair provided in the second reservoir 3 and to detect an electrical change between the electrodes by contacts between the electrodes and the liquid surface.

Further, the liquid surface detection unit 5 may be configured to detect a liquid surface position in the second reservoir 3 by utilizing an electrostatic capacitance type sensor. And the liquid surface detection unit 5 may be configured to include a float in the second reservoir 3 to detect the liquid surface by detecting a position of the float.

Although, in the embodiment, a syringe pump, a tube pump, a diaphragm pump, a gear pump or the like is exemplified as the pump 63, a pump suitable for performance of the discharge apparatus 100 can be employed. For example, in a case where the third reservoir 61 defines a sealed space, it may be configured that the operation liquid is supplied to the second reservoir 3 by pressurizing the inside of the third reservoir 61.

Furthermore, in a case where there is a difference of liquid surface in height between the second reservoir 3 and the third reservoir 61 and one end of the flow path 62 extends in the operation liquid of the second reservoir 3, the flow path 62 is required to be in a closed state even during supply of the operation liquid is stopped. In this case, a pump capable of closing the flow path during the stop may be used and the above-mentioned one end of the flow path 62 may also be disposed at a position above the liquid surface of the operation liquid in the second reservoir 3. Alternatively, a valve capable of closing the flow path 62 may be disposed separately.

Second Embodiment

The second embodiment of the invention will be explained with FIG. 5 as follows. It is noted that FIG. 5 is a conceptual view illustrating an imprint apparatus according to the embodiment.

Figure 5:
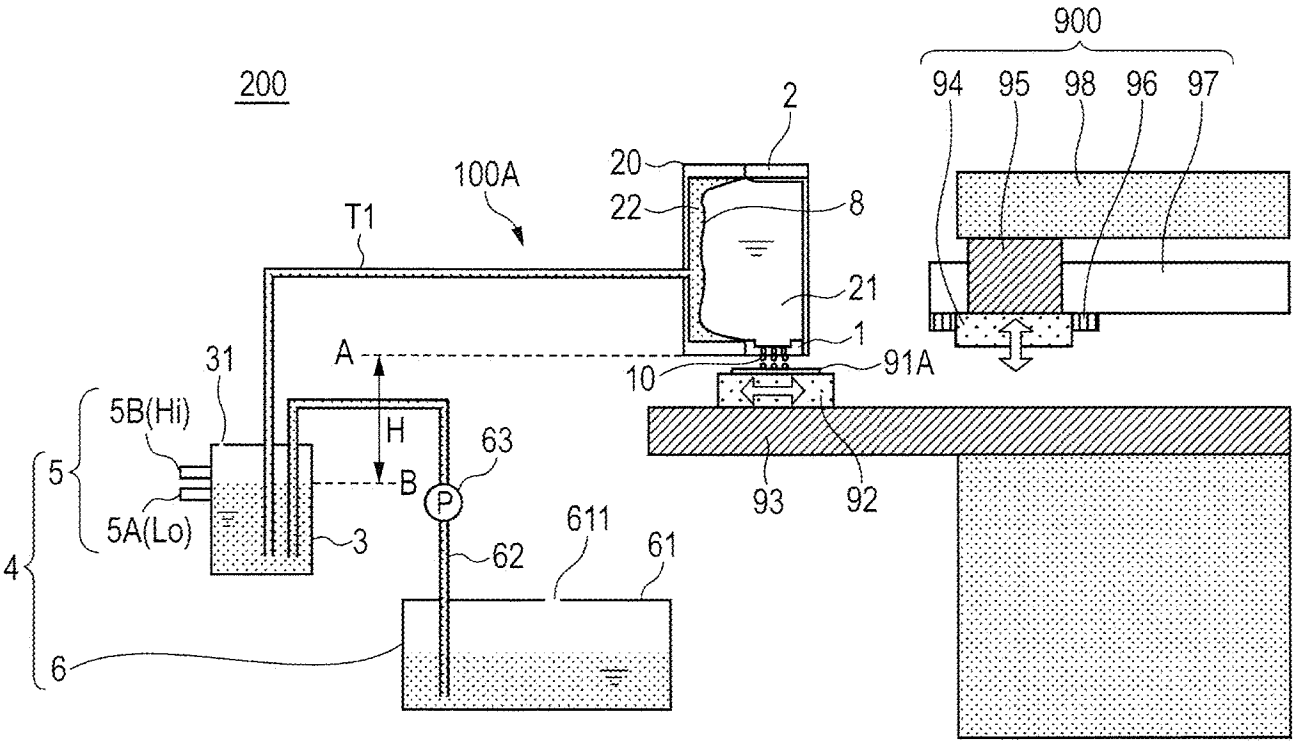
FIG. 5 is a conceptual view illustrating an imprint apparatus according to a second embodiment of the present invention.

As illustrated in FIG. 5, the imprint apparatus 200 of the invention mainly includes a liquid discharge apparatus 100A and a pattern forming portion (forming unit) 900.

It is noted that the liquid discharge apparatus 100A has basically a configuration same as the discharge apparatus 100 of the first embodiment. It is noted that, in the embodiment, a photocurable resist is stored in the first chamber 21 of the first reservoir 2 and the resist is discharged to a wafer substrate 91A (base plate) to be described below from the head 1 communicating with the first chamber 21. On the other hand, an operation liquid having density close to the resist is filled in the second chamber 22.

It is noted that although the resist is configured by a photocurable resin, it may be configured by another photocurable materials (liquid). Further, in the embodiment, an aluminum multilayered film having a width of 10 μm to 200 μm is used as the flexible film 8. The material such as the aluminum multilayered film is suitable for the flexible member, since it is stable against the resist and has a property that liquid and gas are difficult to permeate therethrough.

The pattern forming portion 900 mainly includes a mold 94 and an exposure unit (light irradiation unit) 95. Further, the pattern forming portion 900 includes movement means 96 that moves the mold 94 up and down.

It is noted that the mold 94 is held by the first holding portion 97 through the movement means 96 and the exposure unit 95 is held by a second holding portion 98. Further, the mold 94 is configured by light transmissive quartz material and a fine pattern having a groove shape (unevenness pattern) is formed at one surface (lower surface) side. The exposure unit 95 is disposed over the mold 94 to irradiate across the mold 94 and cure the resist (pattern) on the wafer substrate 91A to be described below.

The pattern forming portion 900 is configured to bring a surface of the substrate 91A on which the liquid is discharged by the head 1 and a surface of the mold 94 on which the unevenness pattern is formed into contact with each other, so as to form the pattern corresponding to the unevenness pattern of the mold on the surface of the substrate 91A.

A forming step for forming a pattern on the surface of the wafer substrate 91A by using the imprint apparatus 200 of the embodiment will be explained below.

In the embodiment, an upper surface of the wafer substrate to which a resist is discharged (applied) and a lower surface of the mold where the unevenness pattern is formed are abutted to each other, and a pattern corresponding to the unevenness pattern formed on the lower surface of the mold is formed on the upper surface of the wafer substrate.

Specifically, the resist is discharged (applied) to the upper surface of the wafer substrate 91A from the head 1 of the liquid discharge apparatus 100A so as to form a predetermined pattern (application step).

Subsequently, the wafer substrate 91A to (on) which the resist (pattern) is applied (formed) is conveyed below the mold 94 by the conveyance means 92.

The mold 94 is lowered downward by the movement means 96 and the lower surface of the mold 94 is pressed on the resist (pattern) formed on the upper surface of the wafer substrate 91A. Thereby, the resist is pressed into and filled in the fine pattern with a groove shape constituting the unevenness pattern formed on the lower surface of the mold 94 (pattern forming step).

In the state where the resist is filled in the fine pattern, ultraviolet rays are irradiated from the exposure unit 95 across the light-transmissive mold 94 to the resist so that a pattern formed from resist is formed on the surface of the wafer substrate 91A (treatment step).

After the pattern has been formed, the mold 94 is raised by the movement means 96, and the pattern formed on the wafer substrate 91A and the mold 94 are separated from each other. The pattern forming step for the wafer substrate 91A is completed.

Similarly to the first embodiment, in the embodiment the liquid surface in the second reservoir 3 is disposed below the discharge port surface 10, and further the liquid surface in the second reservoir is adjusted to fall within a predetermined range by the adjustment unit 4, so that the pressure in the head 1 can be controlled to fall within the predetermined range (negative pressure) stably. Therefore, leakage of the resist (liquid) from the head 1 can be suppressed effectively. Further, the resist can also be discharged from the head 1 stably.

Further, in the embodiment, since the space in the first reservoir 2 is filled with the resist and the operation liquid that have densities close to each other, vibration is suppressed effectively even if an impact is applied to the housing 20. Therefore, the pressure in the head 1 is hardly affected by vibration so that the inside of the head 1 can be maintained in a state of negative pressure stably.

Furthermore, in the embodiment, the operation liquid to be filled in the second chamber 22 is hardly affected by changes of surrounding temperature and pressure, compared with gas. Accordingly, even if temperature or pressure fluctuates around the imprint apparatus 200, a pressure fluctuation of the resist in the head 1 communicating with the first chamber 21 can be suppressed surely since the volume of operation liquid hardly fluctuates.

The imprint apparatus of the invention can be used to make for example semiconductor manufacturing apparatuses, nano-imprint apparatuses and the like that manufacture devices, for example, such as a semiconductor integrated circuit element, a liquid crystal display element and the like.

A part can be manufactured by using the imprint apparatus of the invention.

Apart manufacturing method may include a step for discharging (applying) a resist to a substrate (wafer, glass plate, film-like substrate and the like) by using an imprint apparatus (head).

Further, included may be the pattern forming step in which a surface of the substrate to which a resist is discharged (applied) and a surface of the mold on which the unevenness pattern is formed are abutted to each other to form a pattern corresponding to the convex and concave pattern of the mold on the surface of the substrate.

Furthermore, included may be a treatment step for treating the substrate on which a pattern is formed. It is noted that included may be an etching treatment step for etching the substrate as the treatment step for treating the substrate.

It is noted that in a case of manufacturing a device (part), such as patterned media (recording media), an optical elements and the like, a processing treatment other than an etching treatment is preferable.

According to the part manufacturing method of the invention, compared to conventional part manufacturing methods, performance, quality and productivity of parts are improved and production costs can also be reduced.

Third Embodiment

A third embodiment will be explained below with reference to FIGS. 6, 7, 8, 9 and 10. It is noted that an ink let recording apparatus (hereinafter referred to as a "discharge apparatus") will be explained as an example of the liquid discharge apparatus of the invention in the embodiment. Further, "ink" used in the discharge apparatus of the embodiment is an example constituting "liquid" used in the discharge apparatus of the invention.

Figure 6:
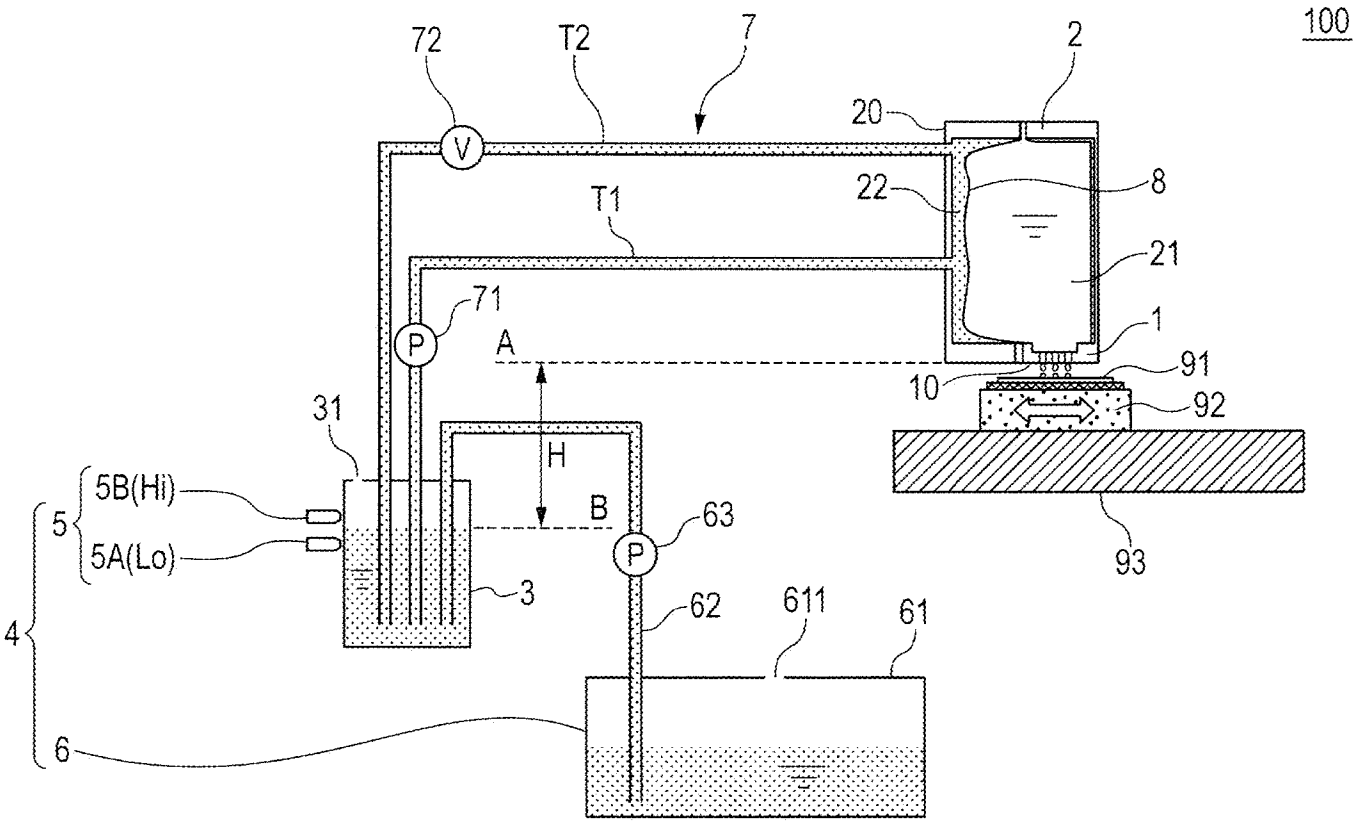
FIG. 6 is a conceptual view illustrating a liquid discharge apparatus according to a third embodiment of the present invention.

FIG. 6 is a conceptual view illustrating a discharge apparatus (liquid discharge apparatus) according to the embodiment.

As illustrated in FIG. 6, in the embodiment, the discharge apparatus 100 mainly includes a head 1 that discharges an ink (liquid), a first reservoir 2 that stores an ink and a second reservoir 3 that stores an operation liquid. Further, the discharge apparatus 100 includes conveyance means 92 that conveys a recording medium 91, a support portion 93 that supports the conveyance means 92 and the like. It is noted that the recording medium 91 is sucked and held on the conveyance means 92 by suction means (not illustrated).

The first reservoir 2 includes a rectangular parallelepiped housing 20 in a substantially sealed state and the head 1 is mounted on the bottom portion of the housing 20. The first reservoir 2 includes no atmosphere communicating opening. It is noted that the head 1 includes a discharge port surface 10 provided with a discharge port (not illustrated) at the bottom surface of the housing 20.

Inside the housing 20, a flexible film 8 (flexible member) having a flexible property is provided and the flexible film 8 separates the first reservoir 2 into a first chamber 21 and a second chamber 22. The first chamber 21 communicates with an inside of the head 1 provided at the bottom portion of the housing 20 and stores ink to be supplied to the head 1. On the other hand, the second chamber 22 communicates with the second reservoir 3 through a first flow path T1 and stores an operation liquid to be supplied from the second reservoir 3. The first flow path is connected with the second chamber at a position lower than a position where the second flow path is connected.

It is noted that in the embodiment the first chamber 21 is filled with the ink and the second chamber 22 is filled with the operation liquid. The ink (liquid) in the first chamber 21 is what is sealed in advance.

On the other hand, the first reservoir 2 is configured to be removable with respect to the apparatus main body, and in a case where the ink (liquid) in the first reservoir 21 has been consumed, the first reservoir 2 can be replaced with a new one. Therefore, the first reservoir is not required to be provided with a replenishment mechanism (for example, an replenishment opening) for replenishing the first chamber 21 with the ink, and further there is little chance that the ink (liquid) in the first reservoir 2 is brought in contact with the outside, thereby preventing impurities from being mixed by the replenishment operation, too.

Further, in the embodiment, in addition to the first flow path 1, a second flow path T2 is provided between the second chamber 22 and the second reservoir 3. Namely, the second chamber 22 and the second reservoir 3 are connected with each other by the first flow path T1 and the second flow path T2 that are juxtaposed.

One ends (lower ends), connected with the second reservoir 3, of the first flow path T1 and the second flow path T2 are disposed not above the liquid surface of the operation liquid in the second reservoir 3. Further, the first flow path T1 and the second flow path T2 are configured to be filled with the operation liquid.

In the embodiment, the first flow path T1 and the second flow path T2 are configured by a tube or the like. Further, by provision of a joint portion each in the middle of the first flow path T1 and in the middle of the second flow path T2, the second reservoir 3 and the first reservoir 2 may be configured to be separatable (removal) from each other.

Furthermore, as illustrated in FIG. 6, in the embodiment, an opening/closing valve 72 is provided on the second flow path 12, and the opening/closing valve 72 is in a closed state to shut off the second flow path 12 during except for a bubble removal operation (control) to be described below.

On the other hand, a circulation pump 71 (circulation unit) is provided on the first flow path T1, and can circularly move the operation liquid in a circulation flow path constituted by the first flow path T1, the second chamber 22, the second flow path 12 and the second reservoir 3. It is noted that the circular pump 71 may also be provided on the second flow path 12, and may also be provided on both of the first flow path and the second flow path. Further, the circulation pump 71, together with the second flow path 12, constitutes the bubble removal unit 7 to be described below.

The circulation pump 71 is required to have a pump function, and a syringe pump, a tube pump, a diaphragm pump, a gear pump or the like may also be employed. It is noted that during drive stoppage of the circulation pump 71, the first flow path T1 is required to be in an opened state, so that in a case where a pump not allowing communication during the drive stoppage is used, a configuration, such as a bypass flow path, an opening/closing valve and the like may also be added separately.

It is noted that in the embodiment, as described below, in order to maintain a negative pressure in the head 1 more stably, a liquid having density substantially equal to the ink in the first chamber 21 is employed as the operation liquid in the second chamber 22. Furthermore, the operation liquid is an incompressible substance, and for example a liquid, such as water and the like and a gelled substance can be used as the operation liquid.

As illustrated in FIG. 6, an atmosphere communicating opening 31 is provided at an upper portion of the second reservoir 3 so that the second reservoir 3 is opened to atmosphere. To always maintain a state of negative pressure in the head 1 in the state where the second reservoir 3 is opened to atmosphere, a position B of the liquid surface of the operation liquid in the second reservoir 3 is disposed below a position A of the discharge port surface 10 of the head 1. Namely, a state of negative pressure in the head 1 is maintained by difference in height (head difference H) between the position A of the discharge port surface 10 and the position B of the liquid in the second reservoir 3 that stores the operation liquid in the discharge apparatus 100 of the embodiment.

When the ink in the first reservoir 2 (first chamber 21) is consumed, the operation liquid is supplied from the second reservoir 3 to the second chamber 22 by capillary force. Accordingly, the liquid surface of the operation liquid is lowered in the second reservoir 3 and the head difference H between the position A and the position B fluctuates.

In the embodiment, the discharge apparatus 100 includes adjustment unit 4 that makes adjustment in such a manner that a position of the liquid surface of the operation liquid falls within a predetermined range in the second reservoir 3, in order that a negative pressure is maintained to fall within a predetermined range in the head 1.

Specifically, the adjustment unit 4 includes liquid surface detection unit 5 that detects a position of the liquid surface in the second reservoir 3 and replenishment means 6 that replenishes the second reservoir 3 with the operation liquid.

The liquid surface detection unit 5 includes a lower limit position sensor 5A and an upper limit position sensor 5B in the second reservoir 3. The lower limit position sensor 5A and the upper limit position sensor 5B are disposed in such a manner that a pressure (negative pressure) falls within a predetermined range in the head 1. It is noted that the lower limit position sensor 5A and the upper limit position sensor 5B are an optical sensor.

The liquid surface is maintained to fall within a predetermined range (between a lower limit position Lo and an upper limit position Hi) in the second reservoir 3 so that a negative pressure is maintained to fall within the predetermined range in the head 1. In other words, unless the liquid surface is lowered to or below the lower limit position to in the second reservoir 3, the negative pressure in the head 1 does not exceed the upper limit of the predetermined range and there is little possibility that a meniscus is broken at the discharge port. On the other hand, unless the liquid surface is raised to or higher than the upper limit position Hi, the negative pressure in the head 1 does not exceed the lower limit of the predetermined range and there is little possibility that the ink is leaked from the head 1.

The replenishment means 6 includes a third reservoir 61 that stores the operation liquid and a flow path 62 connecting the second reservoir 3 with the third reservoir 61, and a pump 63 that is disposed at the flow path 62 and supplies the operation liquid (feeds liquid) to the second reservoir 3 from the third reservoir 61. It is noted that the third reservoir 61 includes an atmosphere communicating opening 611 similarly to the second reservoir 3 and is opened to atmosphere. Further, the pump 63 is stopped except for during a replenishment operation for replenishing the second reservoir 3 with the operation liquid and the flow path 62 is also in a closed state.

Furthermore, when it is detected by the lower limit position sensor 5A that the liquid surface is lowered to the lower limit position to in the second reservoir 3, the replenish means 6 (pump 63) is operated to replenish the second reservoir with the operation liquid from the third reservoir and to recover the liquid surface to the lower limit position Lo or higher in the second reservoir. When it is detected that the liquid surface is reached to the upper limit position Hi in the second reservoir 3 again, the pump 63 is stopped. Therefore, the negative pressure can be maintained to fall within the predetermined range in the head 1.

Control for replenishing the second reservoir with the operation liquid from the third reservoir will be explained below.

When it is started that an ink is discharged from the head 1, replenishment control for replenishing the second reservoir with the operation liquid from the third reservoir is started based on detection results of the liquid surface detection unit 5. Namely, simultaneously with the start of the discharge operation of the head 1, detection (monitoring) of the liquid surface in the second reservoir is started by the lower limit position sensor 5A installed in the second reservoir 3.

It is noted that when it is detected that the liquid surface is lowered to the lower limit position to in the second reservoir 3 by the lower limit position sensor 5A, the pump 63 is driven to feed the operation liquid from the third reservoir 61 to the second reservoir 3.

Further, when the operation liquid is supplied from the third reservoir 61 to the second reservoir 3, the liquid surface is raised in the second reservoir 3. When it is detected by the upper limit position sensor 5B that the liquid surface is raised to the upper limit position Hi in the second reservoir 3, the pump 63 is stopped and the replenish control is completed.

Namely, until it is detected by the upper limit position sensor 5B that the liquid surface reaches the upper limit position Hi in the second reservoir 3, the liquid feeding operation is continued by the pump 63.

As described above, in the embodiment, the liquid surface in the second reservoir 3 is made to be disposed below the discharge port surface 10 and further, the liquid surface in the second reservoir 3 is adjusted to fall within the predetermined range by the adjustment unit 4 so that the pressure in the head 1 can be controlled to fall within the predetermined range (negative pressure) stably. Therefore, ink leakage from the head 1 can be suppressed effectively. Further, ink can be discharged from the head 1 stably, too.

Specifically, in the embodiment, the first reservoir 2 (first chamber 21 and second chamber 22) is filled with the ink and the operation liquid having density close to each other so that vibration is suppressed effectively even if an impact is applied to the housing 20. Therefore, the pressure in the head 1 is hardly affected by vibration so that the inside of the head 1 can be maintained in a state of negative pressure stably.

It is noted that, in the embodiment, the operation liquid to be filled in the second chamber 22 is hardly affected by changes of surrounding temperature and pressure, compared with gas, in the embodiment. Accordingly, even if temperature or pressure fluctuates around the discharge apparatus 100, the pressure of the ink in the head 1 communicating with the first chamber 21 can be suppressed surely since the volume of the operation liquid hardly fluctuates.

The detail on the flexible film 8 (flexible member) of the discharge apparatus 100 will be explained below.

As illustrated in FIG. 6, in the embodiment, the flexible film 8 is connected with each of a top face, a bottom face and two side faces of the housing, and is provided in the housing 20 along a direction (longitudinal direction) along a vertical direction. With this arrangement, the first chamber 21 and the second chamber 22 are formed dividedly into right and left in the housing 20.

When the ink in the first chamber 21 of the first reservoir 2 is consumed, the flexible film 8 is deformed, a volume of the first chamber 21 is decreased and a volume of the second chamber 22 is expanded. Accordingly, a volume of the operation liquid equal to that of the ink consumed in the first chamber 21 is supplied from the second reservoir 3 to the second chamber 22 through the first flow path T1. In this occasion, the flexible film 8 is moved from left to right along a horizontal direction as illustrated in FIG. 6.

In other words, although a volume ratio between the ink and the operation liquid stored in the first reservoir 2 fluctuates by ink consumption, a gravity center of the first reservoir 2 substantially remains unchanged since the concentration of the operation liquid is substantially the same as that of the ink. Therefore, a stable negative pressure can be maintained in the head 1 positioned at a lower portion of the housing 20.

Specifically, in the embodiment, the flexible film 8 is disposed along the vertical direction, so that even if the operation liquid different in density from the ink is employed, the gravity center of the first reservoir 2 (liquid) is shifted by ink consumption in only the horizontal direction and is hardly shifted in a height direction.

In contrast, in a case where the flexible film 8 is disposed in the horizontal direction, the gravity center of the first reservoir 2 is shifted in the height direction as the ink is consumed. In a case where the flexible film 8 is disposed in the vertical direction, compared with the case where the flexible film 8 is disposed in the horizontal direction, a negative pressure is maintained stably in the head 1. Accordingly, an arrangement of the flexible film 8 (flexible member) in the vertical direction brings out effects that options for usable operation liquids are increased to facilitate design. For example, in a case where the operation liquid different in density from the liquid in the first reservoir 2 is used, operation liquid having density that falls within a range of 80% to 120% with respect to density of the liquid, may be used.

It is noted that the flexible film 8 does not necessarily have to be disposed along the vertical direction and may be disposed along a direction (longitudinal direction) along the vertical direction. Namely, even in a case where the flexible film 8 is disposed along the longitudinal direction, there is little shift amount of the gravity center of the first reservoir 2 by ink consumption in a height direction and a negative pressure can be maintained relatively stably in the head 1.

It is noted that in the embodiment, although the example in which the flexible film 8 is connected with the top face, the bottom face and the side faces of the housing, and the housing is formed to be divided into the first chamber 21 and the second chamber 22 has been explained, another arrangement configuration can be made. For example, the flexible film 8 may be installed in the housing 20 in such a manner that the first chamber 21 that stores the ink is substantially surrounded by the second chamber 22 that stores the operation liquid. Namely, the flexible film 8 may be installed in the housing 20 in such a manner that the first chamber 21 (space) that stores the ink is enclosed by the flexible film 8.

Further, it is preferable to select a member of the flexible film 8 used in the embodiment, which member is suitable for a characteristic of the ink (liquid stored in the first chamber) from the point of view of a liquid contact property and the like.

In the embodiment, although the ink let recording apparatus that discharges the ink has been explained as an example of the liquid discharge apparatus, the invention may be properly modified and applied to, a for example, a liquid discharge apparatus that discharges a liquid, such as a conductive liquid, a UV curable liquid or the like.

Although in the embodiment, the configuration that the head 1 is mounted on and integrated with the lower portion of the housing 20 of the first reservoir 2 has been explained, the head 1 and the first reservoir 2 may be separately configured and the head 1 and the first reservoir 2 (first chamber 21) may be connected with each other by a connection tube.

Although in the embodiment, the volume of the housing 20 is made 500 ml, an initial amount of the ink in the first chamber 21 is made approximately 400 ml, and an initial amount of the ink in the second chamber 22 is made approximately 100 ml, they may be changed properly.

For example, it may be set that the volume of the housing 20 is made 400 ml, the initial amount of ink in the first chamber 21 is also made approximately 400 ml, and the operation liquid is made a minimum value that is close to 0 in an initial state. Namely, in a case where mixing of air is negligible, the operation liquid may not be filled in the second chamber 22 in the initial state.

In the embodiment, the first reservoir 2 (head 1) is mounted on a carriage (not illustrated), and the ink is discharged together with the movement of the carriage to perform recording operation. Even in a case where the first reservoir 2 is moving, the inner space of the first reservoir 2 is filled with the ink and the operation liquid, so that rocking movement of the flexible film 8 is suppressed. Therefore, it is unlikely that a pressure fluctuation occurs in the head 1 and ink leakage from the head 1 is reduced.

Although, in the embodiment, the optical sensors are utilized as the liquid surface detection unit 5, for example, the liquid surface detection unit 5 may be configured to include an electrode pair provided in the second reservoir 3 and to detect an electrical change between the electrodes by contacts between the electrodes and the liquid surface.

Further, the liquid surface detection unit 5 may be configured to detect a liquid surface position in the second reservoir 3 by utilizing an electrostatic capacitance type sensor. And the liquid surface detection unit 5 may be configured to include a float in the second reservoir 3 to detect the liquid surface by detecting a position of the float.

Although, in the embodiment, a syringe pump, a tube pump, a diaphragm pump, a gear pump or the like is exemplified as the pump 63, a pump suitable for performance of the discharge apparatus 100 can be employed. For example, in a case where the third reservoir 61 defines a sealed space, it may be configured that the operation liquid is supplied to the second reservoir 3 by pressurizing the inside of the third reservoir 61.

Furthermore, in a case where there is a difference of liquid surface in height between the second reservoir 3 and the third reservoir 61 and one end of the flow path 62 extends in the operation liquid of the second reservoir 3, the flow path 62 is required to be in a closed state even during supply of the operation liquid is stopped. In this case, a pump capable of closing the flow path during the stop may be used and the above-mentioned one end of the flow path 62 may also be disposed at a position above the liquid surface of the operation liquid in the second reservoir 3. Alternatively, a valve capable of closing the flow path 62 may be disposed separately.

The bubble removal unit 7 of the embodiment will be explained below.

Figure 7:
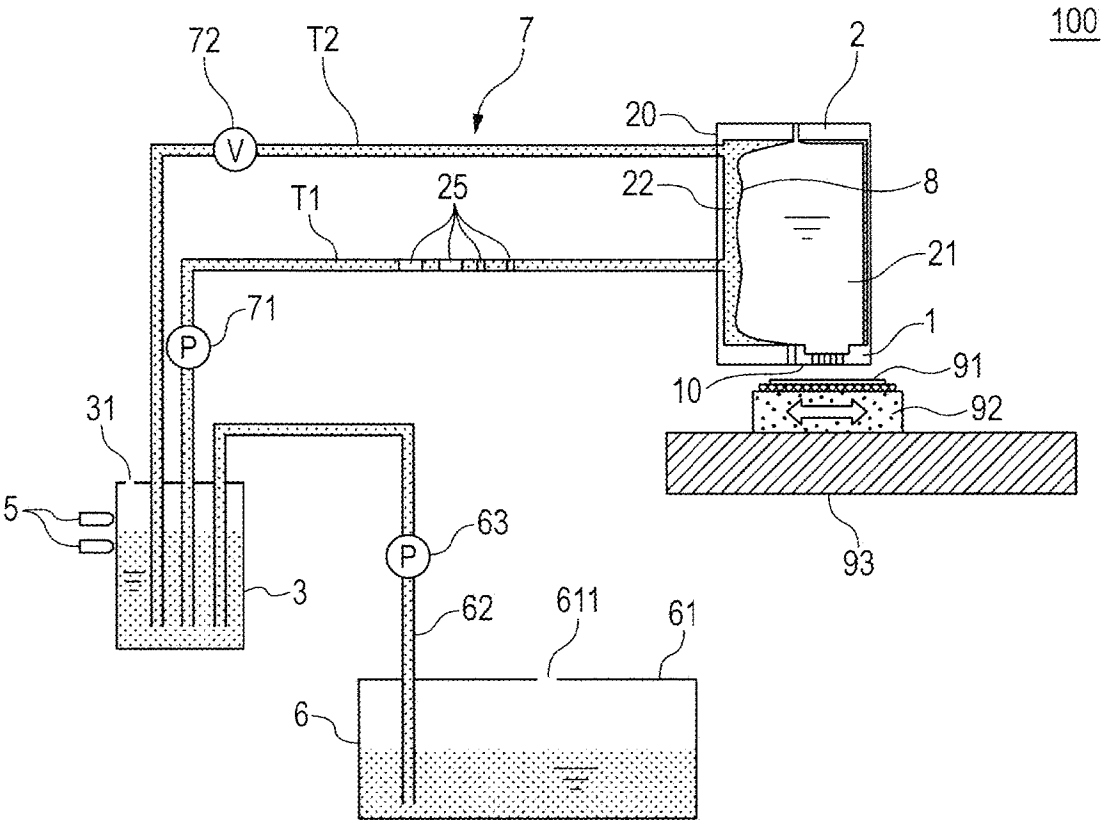
FIG. 7 is a conceptual view illustrating a state where bubbles have occurred in a first flow path in the third embodiment.

FIG. 7 is a conceptual view illustrating a state where bubbles 25 have occurred in the first flow path in the embodiment. As illustrated in FIG. 7, air in the atmosphere permeates a tube wall of a tube constituting the first flow path T1 and bubbles 25 are formed in an inner wall surface of the first flow path T1. Those bubbles 25 are deposited and grown with time, and a flow path resistance of the first flow path T1 increases.

When the flow path resistance increases in the first flow path T1 due to the presence of the bubbles 25, it becomes difficult for the operation liquid to flow from the second reservoir 3 to the second chamber 22 to deteriorate discharge performance of the head 1. Further, there is possibility that, due to the presence of the bubbles 25 in the flow path T1, the head difference between the discharge port surface 10 of the head 1 and the liquid surface in the second reservoir 3 becomes an unstable state and a negative pressure in the head 1 is no longer maintained stably.

In the embodiment, the discharge apparatus 100 includes the bubble removal unit 7, the bubbles 25 in the flow path is removed periodically by the bubble removal unit 7 and increase of the flow path resistance due to growth of the bubbles can be suppressed.

Specifically, the bubble removal unit 7 of the embodiment mainly includes the second flow path T2 and the circulation pump (circulation unit) 71 capable of moving a liquid by rotational movement. The operation liquid in the second reservoir 3 is circulated through the first flow path T1 and the second flow path T2 by driving the circulation pump 71 in an opened state of the second flow path T2 (opening/closing valve 72). With this arrangement, the operation liquid containing the bubbles 25 in the first flow path T1 can be moved to the second reservoir 3 so that the bubbles 25 can be released in the second reservoir 3.

It is noted that although in the embodiment the circulation unit is constituted by the circulation pump 71, another configuration may be employed as the circulation unit. For example, the circulation unit may be constituted by combining a check valve and a piston pump.

Figure 8:
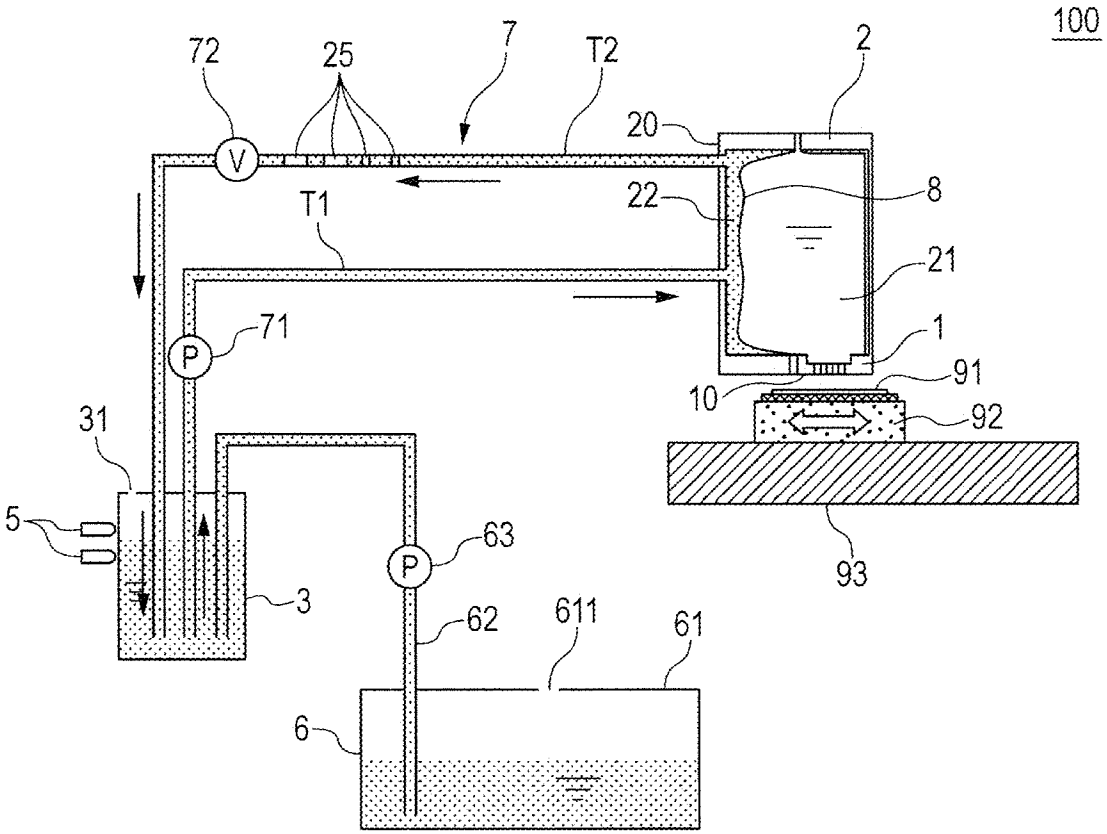
FIG. 8 is a conceptual view illustrating an intermediate state where the bubbles illustrated in FIG. 7 are moved.
Figure 9:
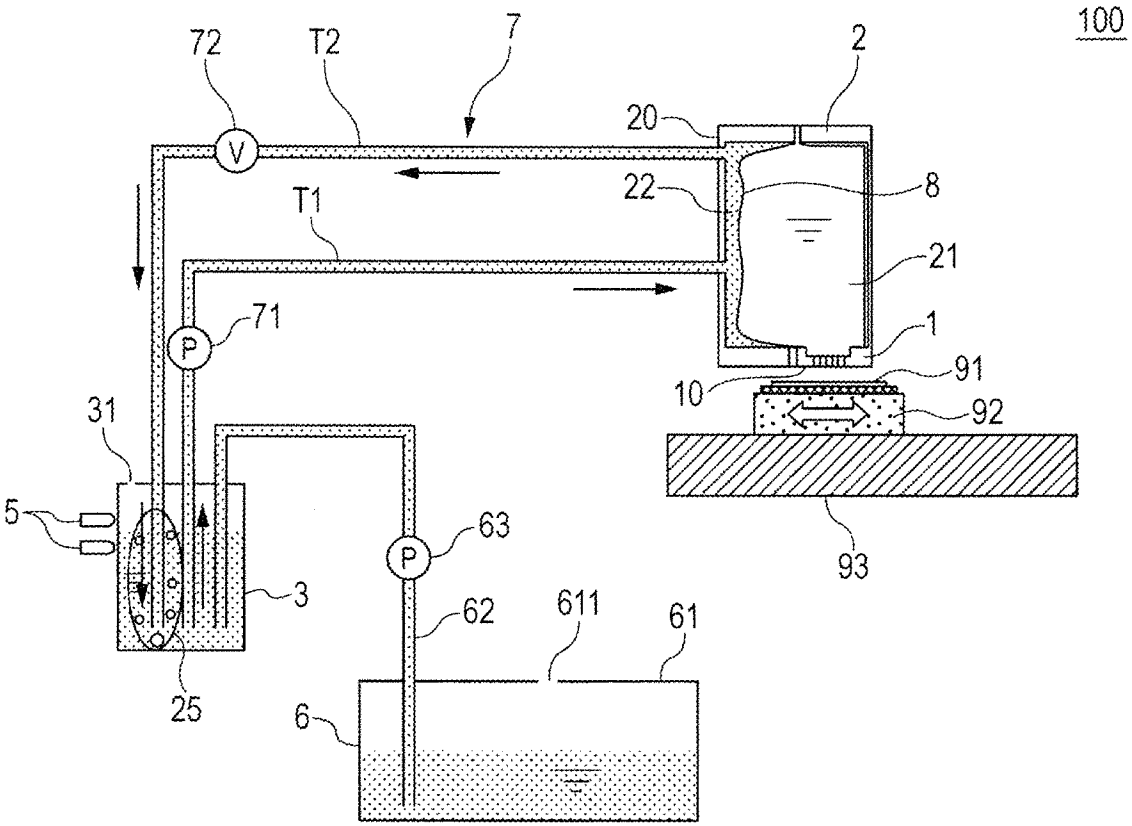
FIG. 9 is a conceptual view illustrating a state where the bubbles illustrated in FIG. 7 have been finally released into the second reservoir.

FIG. 8 illustrates an intermediate state where the bubbles 25 are moved by the bubble removal unit 7. FIG. 9 illustrates a state where the bubbles 25 have been finally released into the second reservoir 3.

As illustrated in FIGS. 8 and 9, the operation liquid containing the bubbles 25 in the first flow path T1 are moved from the first flow path T1 to the second chamber 22 by driving the circulation pump 71, and further to the second flow path T2 connected with the upper portion of the second chamber 22. Furthermore, the operation liquid containing the bubbles 25 is finally moved (released) into the second reservoir 3 through the second flow path T2. It is noted that the second reservoir 3 is opened to atmosphere through the atmosphere communication opening 31.

Figure 10:
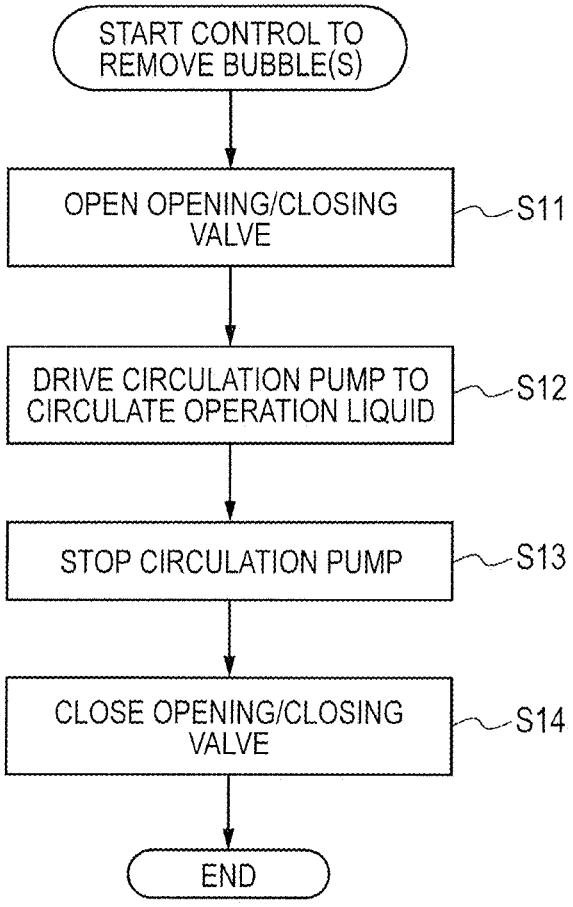
FIG. 10 is a flow chart illustrating control for removing the bubbles in the first flow path.

Control for removing bubbles in the flow path will be explained below. FIG. 10 is a flow chart illustrating control for removing bubbles 25 in the first flow path T1.

It is noted that a bubble removable operation is controlled by a timer or the like to be performed periodically. Namely, when a predetermined time elapses, it is determined that a bubble occurs in the first flow path and the bubble removable operation (control) is performed by the bubble removal unit 7.

As illustrated in FIG. 10, when the bubble removal control is started, the opening/closing valve 72 disposed on the second flow path T2 is switched from the closed state to the opened state (S11).

After the second flow path T2 has been in the opened state, the circulation pump 71 is driven to circulate the operation liquid (S12). Namely, the operation liquid is supplied from the second reservoir 3 to the second chamber 22 through the first flow path T1 and collected from the second chamber 22 to the second reservoir 3 through the second flow path T2 by driving the circulation pump 71. Therefore, the operation liquid is circulated in an order of the second reservoir 3, the first flow path T1, the second chamber 22 and the second flow path T2 and the second reservoir 3.

By circulating the operation liquid by the circulation pump 71, the bubbles occurring in the first flow path T1 are moved, together with a flow of the operation liquid, to the second reservoir 3 and are expelled.

It is noted that after the operation liquid has been circulated by the circulation pump 71 in a predetermined time (for example 5 minutes), it is determined that the bubbles in the first flow path T1 are removed and the circulation pump 71 is stopped (S13). And the opening/closing valve 72 is switched from the opened state to the closed state (S14) and the bubble removable control is completed.

Further, to prevent the bubble removable operation from influencing on a discharge operation of the head 1, it is preferable that the bubble removal operation is performed during a period when the discharge operation of the head 1 is not performed. Furthermore, to suppress pressure in the head, a liquid feeding speed of the circulation pump 71 may also be set to a predetermined speed or less. Additionally, in a case where a period when the discharge operation of the head 1 is not performed is short, the bubble removable operation may also be divided into plural times to be performed during the period when the discharge operation is not performed.

The opening/closing valve 72 is closed after the operation liquid has been circulated by the circulation pump 71 so that even if the bubbles 25 are being moved (present) in the second flow path T2, no bubble flows into the second chamber 22 from the second flow path T2.

As described above, by circulating the operation liquid by the circulation pump 7 (circulation unit) in the second reservoir 3 through the first flow path T1, the second chamber 22 and the second flow path T2, a bubble in the flow paths including the flow path T1 can be removed. Thereby, the flow path resistance of the first flow path T1 can be prevented from increasing and the discharge performance of the head 1 can be maintained. Further, the head difference between the discharge port surface 10 of the head 1 and the liquid surface in the second reservoir 3 is maintained in a stable condition so that a negative pressure can be maintained stably in the head 1.

Fourth Embodiment

The fourth embodiment of the invention will be explained with FIG. 11 as follows.

It is noted that in the embodiment, an ink let recording apparatus (hereinafter referred to as a "discharge apparatus") will be explained as an example of the liquid discharge apparatus similarly to the third embodiment.

Figure 11:
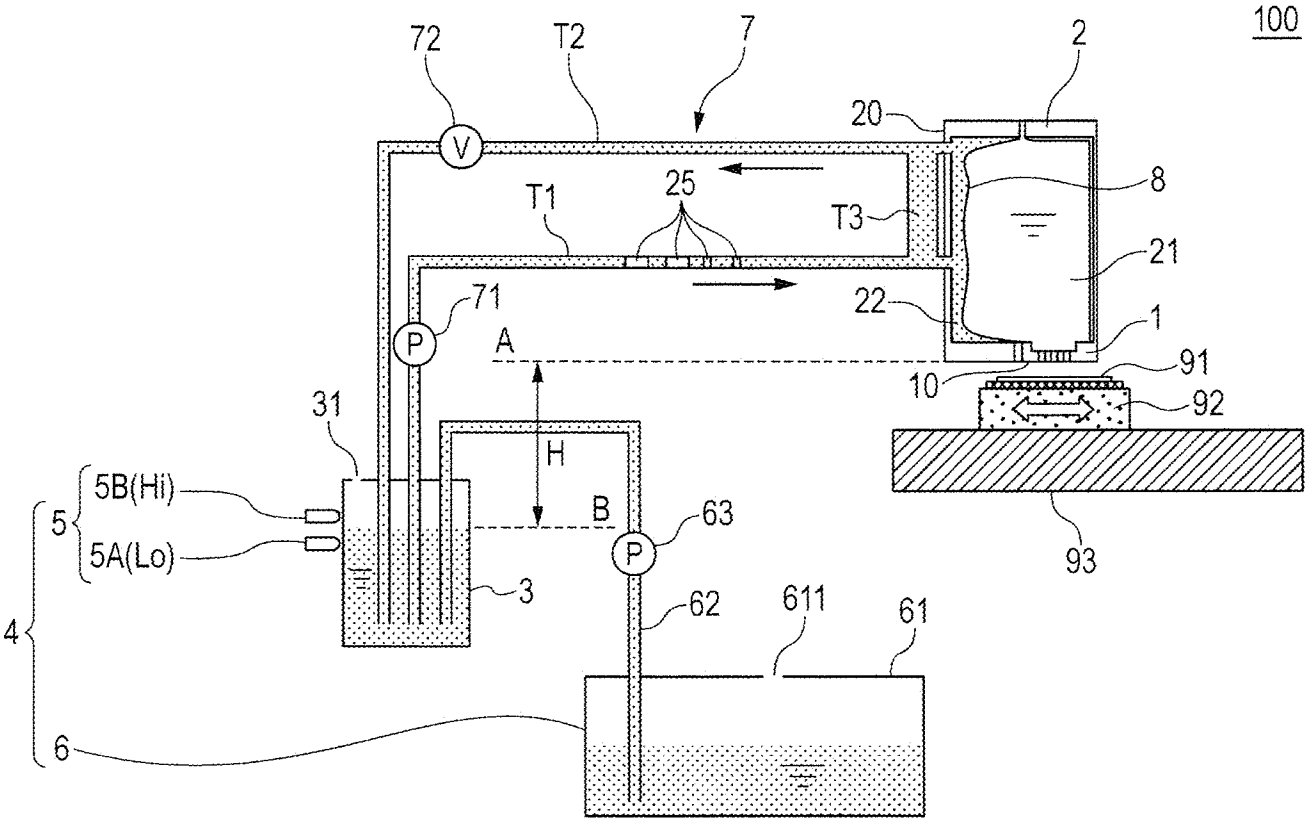
FIG. 11 is a conceptual view of a liquid discharge apparatus according to a fourth embodiment of the present invention.

FIG. 11 is a conceptual view illustrating a liquid discharge apparatus according to the embodiment. As illustrated in FIG. 11, the discharge apparatus 100 of the embodiment basically similar to the third embodiment but is different in bubble removal unit 7.

Namely, in the embodiment, the bubble removal unit 7 further includes a connection flow path T3 that connects a middle of the first flow path T1 with a middle of the second flow path T2.

After the opening/closing valve 72 has been switched from the closed state to the opened state, the operation liquid containing the bubbles 25 in the first flow path T1 is moved by driving the circulation pump 71 from t first flow path T1 to the connection flow path T3 and the second chamber 22. And the operation liquids, after passing through the connection flow path 13 and the second chamber 22, are merged in the second flow path 12. Further, through the second flow path 12, the operation liquid containing the bubbles 25 are finally moved (released) to the second reservoir 3.

As described above, in the embodiment, upon moving the operation liquid containing the bubbles in the first flow path T1, an amount of the operation liquid passing through the second chamber 22 by the connection flow path 13 can be reduced and a negative pressure at the head 1 side can be maintained stably.

Specifically, if a flow path diameter of the connection flow path 13 is set larger than flow path diameters of the first flow path T1 and the second flow path 12, the operation liquid in the first flow path T1 flows easily to the connection flow path 13 side than the second chamber 22 side, so that an influence on the pressure in the second chamber 22 (head 1 side) can be reduced.

Further, the bubbles in the first flow path T1 can be expelled more easily by positioning a position where the connection flow path 13 is connected with the first flow path T1 closer to the second chamber 22 side than the second reservoir 3 side.

Fifth Embodiment

The fifth embodiment of the invention will be explained with FIGS. 12 and 13 as follows.

It is noted that in the embodiment, an ink jet recording apparatus (hereinafter referred to as a "discharge apparatus") will be explained as an example of the liquid discharge apparatus similarly to the fourth embodiment.

Figure 12:
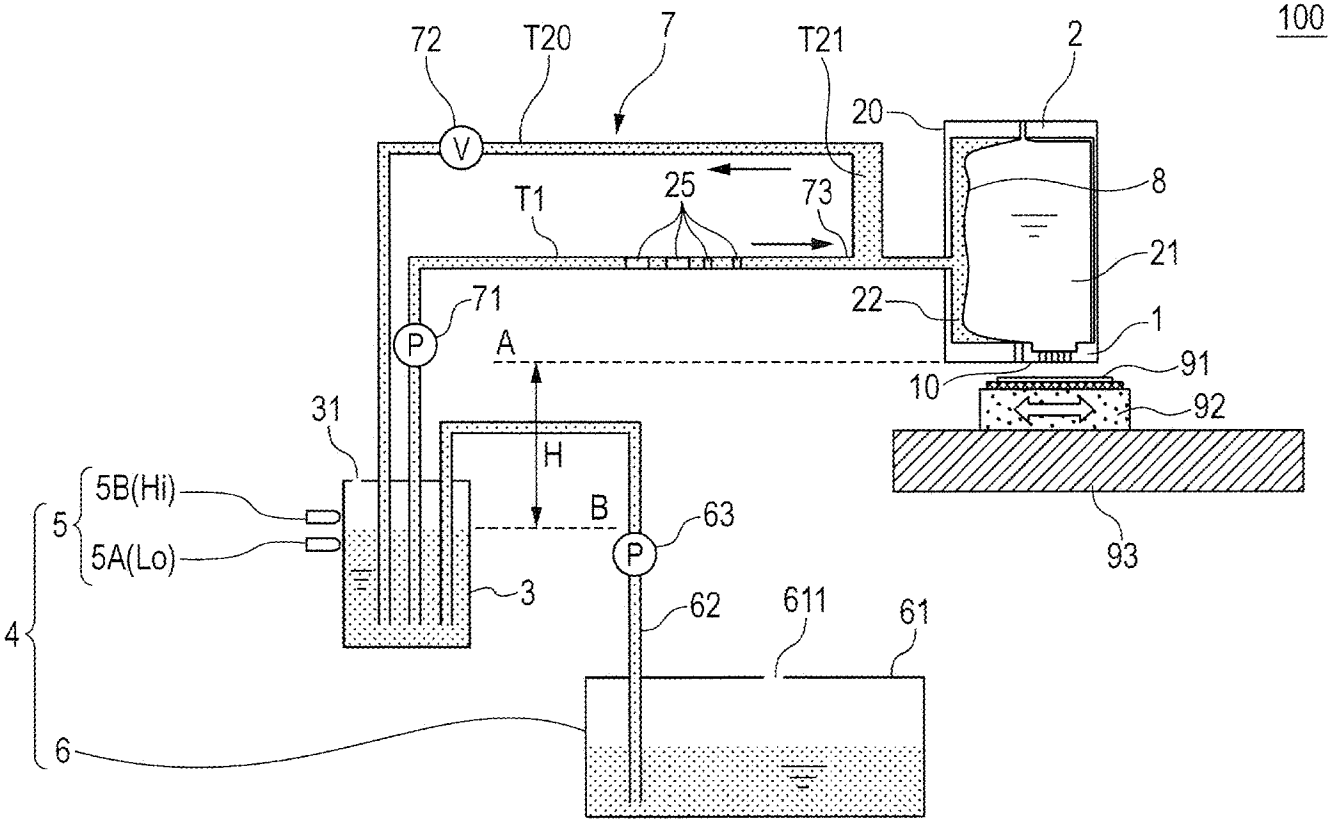
FIG. 12 is a conceptual view illustrating a liquid discharge apparatus according to a fifth embodiment of the present invention.

FIG. 12 is a conceptual view illustrating a liquid discharge apparatus according to the embodiment. FIG. 13 is a conceptual view illustrating a liquid discharge apparatus according to a modified example of the embodiment.

As illustrated in FIG. 12, the discharge apparatus 100 of the embodiment basically similar to the fourth embodiment but is different in bubble removal unit 7.

Specifically, in the embodiment, the bubble removal unit 7 includes a diverging flow path T20 that is diverged from a diverging point 73 of the first flow path T1 and connects the first flow path T1 with the second reservoir 3.

After the opening/closing valve 72 has been switched from the closed state to the opened state, the operation liquid containing the bubbles 25 in the first flow path T1 is moved from the first flow path T1 to the diverging flow path T20 by driving the circulation pump 71. And the operation liquid passes through only the diverging flow path T20 and then is moved (released) to the second reservoir 3.

As described above, in the embodiment, upon moving the operation liquid in the flow paths, the operation liquid does not pass through the second chamber 22 so that a pressure in the second chamber 22 (head 1 side) can be maintained stably.

Similarly to the fourth embodiment, the bubbles in the first flow path T1 can be expelled more easily by positioning a position of the diverging portion closer to the second chamber 22 side than the second reservoir 3 side.

Further, as illustrated in FIG. 12, a flow path diameter of one end T21, connected with the diverging portion 73, of the diverging flow path 120 is made larger than that of the first flow path T1 so that the operation liquid in the first flow path T1 flows more easily from the diverging portion 73 to the diverging flow path 120 side upon circulation of the operation liquid. Thereby, the influence of pressure to be transmitted on the second chamber 22 side is reduced more.

Figure 13:
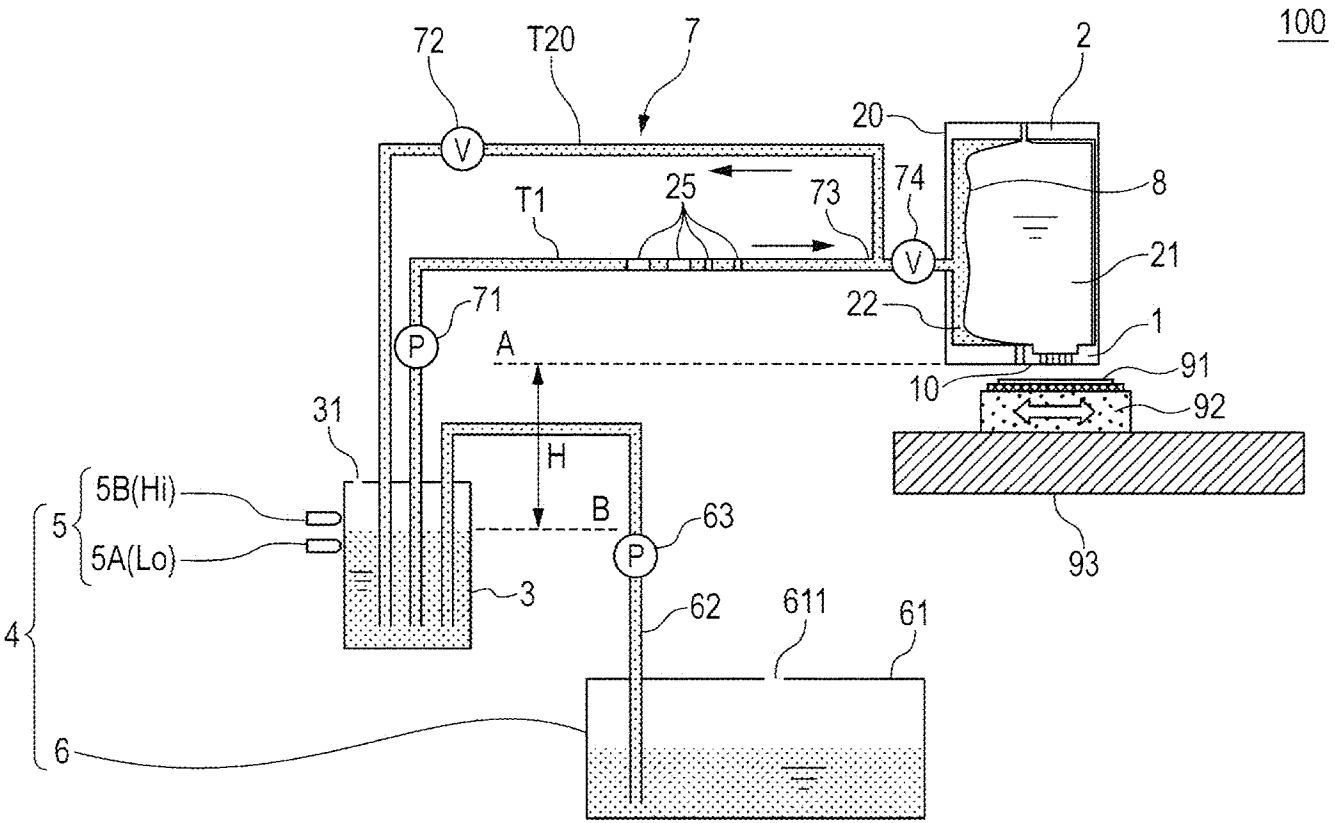
FIG. 13 is a conceptual view illustrating a liquid discharge apparatus according to a modified example of the fifth embodiment of the present invention.

On the other hand, as in the modified example illustrated in FIG. 13, additionally the opening/closing valve 74 can be disposed on the first flow path T1 between the diverging portion 73 and the second chamber 22. With this arrangement, entry of the bubbles 25 in the first flow path into the second reservoir is reduced more by closure of the opening/closing valve 74, upon performing the bubble removable operation. Furthermore, the influence of pressure to be transmitted on the second chamber 22 side from the first flow path T1 can be reduced more and the pressure at the head 1 side can be maintained more stably.

Specifically, provision of the opening/closing valve 74 enables the bubbles 25 in the first flow path T1 to be prevented from being mixed in the first reservoir 1 so that the influence of damper effects caused by the bubbles can be reduced when the operation liquid is necessary to be pressurized or depressurized. For example, this is effective when a cleaning operation is performed on the discharge port of the head 1 by pressurizing the operation liquid.

Sixth Embodiment

The sixth embodiment of the invention will be explained with FIG. 14 as follows. It is noted that FIG. 14 is a conceptual view illustrating an imprint apparatus according to the embodiment.

Figure 14:
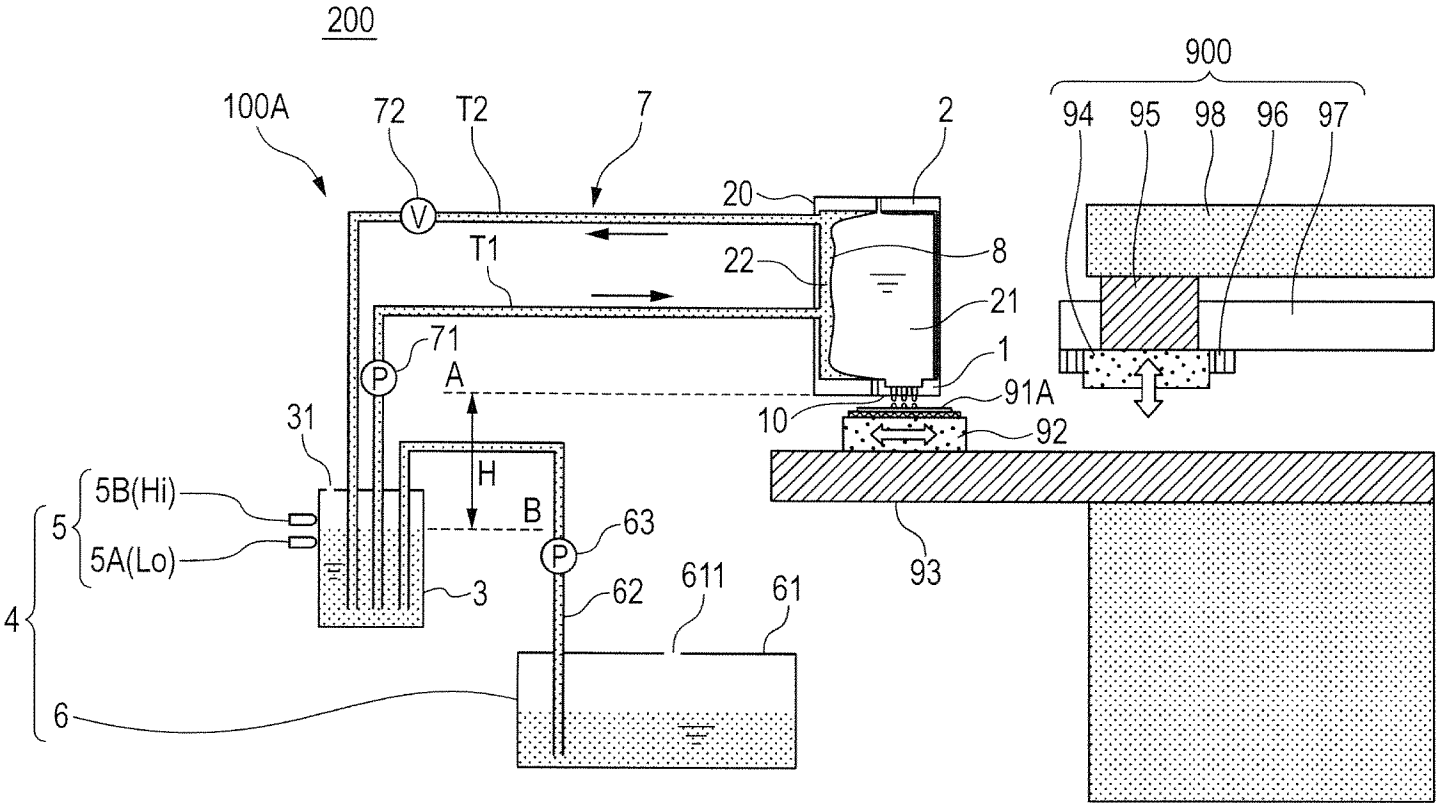
FIG. 14 is a conceptual view illustrating an imprint apparatus according to a sixth embodiment of the present invention.
Figure 15:
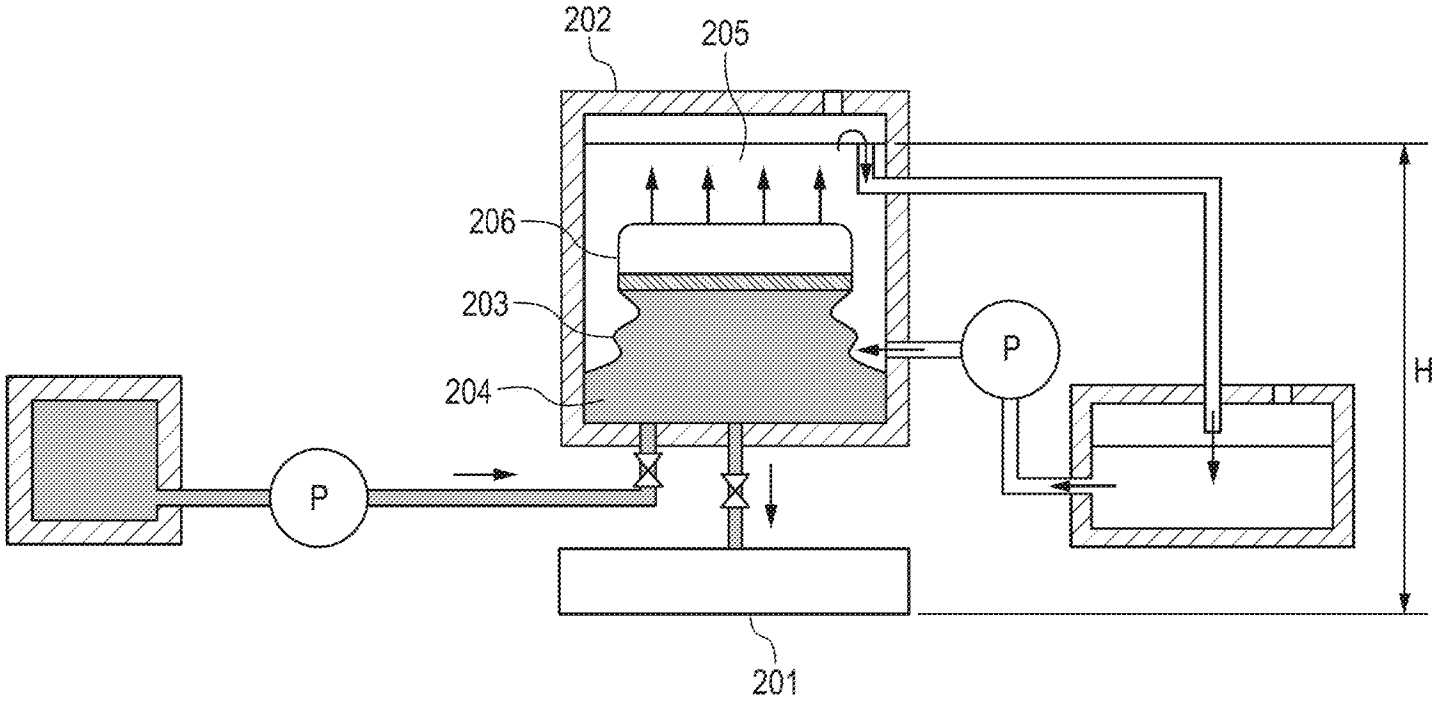
FIG. 15 is an explanatory view illustrating a conventional ink jet apparatus.

As illustrated in FIG. 14, the imprint apparatus 200 of the invention mainly includes a liquid discharge apparatus 100A and a pattern forming portion (forming unit) 900.

It is noted that the liquid discharge apparatus 100A has basically a configuration same as the discharge apparatus 100 of the third embodiment. It is noted that, in the embodiment, a photocurable resist is stored in the first chamber 21 of the first reservoir 2 and the resist is discharged to a wafer substrate 91A (base plate) to be described below from the head 1 communicating with the first chamber 21. On the other hand, an operation liquid having density close to the resist is filled in the second chamber 22.

It is noted that although the resist is configured by a photocurable resin, it may be configured by another photocurable materials (liquid). Further, in the embodiment, an aluminum multilayered film having a width of 10 μm to 200 μm is used as the flexible film 8. The material such as the aluminum multilayered film is suitable for the flexible member, since it is stable against the resist and has a property that liquid and gas are difficult to permeate therethrough.

The pattern forming portion 900 mainly includes a mold 94 and an exposure unit (light irradiation unit) 95. Further, the pattern forming portion 900 includes movement means 96 that moves the mold 94 up and down.

It is noted that the mold 94 is held by the first holding portion 97 through the movement means 96 and the exposure unit 95 is held by a second holding portion 98. Further, the mold 94 is configured by light transmissive quartz material and a fine pattern having a groove shape (unevenness pattern) is formed at one surface (lower surface) side. The exposure unit 95 is disposed over the mold 94 to irradiate across the mold 94 and cure the resist (pattern) on the wafer substrate 91A to be described below.

A forming step for forming a pattern on the surface of the wafer substrate 91A by using the imprint apparatus 200 of the embodiment will be explained below.

In the embodiment, an upper surface of the wafer substrate to which a resist is discharged (applied) and a lower surface of the mold where the unevenness pattern is formed are abutted to each other, and a pattern corresponding to the unevenness pattern formed on the lower surface of the mold is formed on the upper surface of the wafer substrate.

Specifically, the resist is discharged (applied) to the upper surface of the wafer substrate 91A from the head 1 of the liquid discharge apparatus 100A so as to form a predetermined pattern (application step).

Subsequently, the wafer substrate 91A to (on) which the resist (pattern) is applied (formed) is conveyed below the mold 94 by the conveyance means 92.

The mold 94 is lowered downward by the movement means 96 and the lower surface of the mold 94 is pressed on the resist (pattern) formed on the upper surface of the wafer substrate 91A. Thereby, the resist is pressed into and filled in the fine pattern with a groove shape constituting the unevenness pattern formed on the lower surface of the mold 94 (pattern forming step).

In the state where the resist is filled in the fine pattern, ultraviolet rays are irradiated from the exposure unit 95 across the light-transmissive mold 94 to the resist so that a pattern formed from resist is formed on the surface of the wafer substrate 91A (treatment step).

After the pattern has been formed, the mold 94 is raised by the movement means 96, and the pattern formed on the wafer substrate 91A and the mold 94 are separated from each other. The pattern forming step for the wafer substrate 91A is completed.

Similarly to the third embodiment, in the embodiment the liquid surface in the second reservoir 3 is disposed below the discharge port surface 10, and further the liquid surface in the second reservoir is adjusted to fall within a predetermined range by the adjustment unit 4, so that the pressure in the head 1 can be controlled to fall within the predetermined range (negative pressure) stably. Therefore, leakage of the resist (liquid) from the head 1 can be suppressed effectively. Further, the resist can also be discharged from the head 1 stably.

Further, in the embodiment, since the space in the first reservoir 2 is filled with the resist and the operation liquid that have densities close to each other, vibration is suppressed effectively even if an impact is applied to the housing 20. Therefore, the pressure in the head 1 is hardly affected by vibration so that the inside of the head 1 can be maintained in a state of negative pressure stably.

Furthermore, in the embodiment, the operation liquid to be filled in the second chamber 22 is hardly affected by changes of surrounding temperature and pressure, compared with gas. Accordingly, even if temperature or pressure fluctuates around the imprint apparatus 200, a pressure fluctuation of the resist in the head 1 communicating with the first chamber 21 can be suppressed surely since the volume of operation liquid hardly fluctuates.

The imprint apparatus of the invention can be used to make for example semiconductor manufacturing apparatuses, nano-imprint apparatuses and the like that manufacture devices, for example, such as a semiconductor integrated circuit element, a liquid crystal display element and the like.

A part can be manufactured by using the imprint apparatus of the invention.

A part manufacturing method may include a step for discharging (applying) a resist to a substrate (wafer, glass plate, film-like substrate and the like) by using an imprint apparatus (head).

Further, included may be the pattern forming step in which a surface of the substrate to which a resist is discharged (applied) and a surface of the mold on which the unevenness pattern is formed are abutted to each other to form a pattern corresponding to the convex and concave pattern of the mold on the surface of the substrate.

Furthermore, included may be a treatment step for treating the substrate on which a pattern is formed. It is noted that included may be an etching treatment step for etching the substrate as the treatment step for treating the substrate.

It is noted that in a case of manufacturing a device (part), such as patterned media (recording media), an optical elements and the like, a processing treatment other than an etching treatment is preferable.

According to the part manufacturing method of the invention, compared to conventional part manufacturing methods, performance, quality and productivity of parts are improved and production costs can also be reduced.

According to the invention, pressure in the head can be maintained stably and leakage from the head can be suppressed more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-076994, filed Apr. 3, 2015, and Japanese Patent Application No. 2015-076993, filed Apr. 3, 2015, which are hereby incorporated by reference herein in their entirety.

What is claimed is:

1. A liquid discharge apparatus, comprising:

a head including a discharge port surface on which a discharge port is formed to discharge a liquid;

a first reservoir that stores the liquid to be supplied to the head;

a flexible member, separating an inner space of the first reservoir into a first chamber that stores the liquid and a second chamber that stores an operation liquid;

a second reservoir communicating with the second chamber, the second reservoir storing the operation liquid to be supplied to the second chamber, the second reservoir being disposed in such a manner that a liquid surface of the operation liquid stored in the second reservoir is positioned below the discharge port surface; and an adjustment unit that performs adjustment in such a manner that a position of the liquid surface of the operation liquid in the second reservoir is maintained within a predetermined range in a state where the second reservoir is opened to atmosphere.

2. A liquid discharge apparatus according to claim 1, wherein the adjustment unit includes a liquid surface detection unit that detects a position of the liquid surface of the operation liquid in the second reservoir.

3. A liquid discharge apparatus according to claim 2, wherein the adjustment unit includes a third reservoir that stores the operation liquid, a flow path that connects the second reservoir with the third reservoir, a pump that is disposed at the flow path and supplies the operation liquid from the third reservoir to the second reservoir.

4. A liquid discharge apparatus according to claim 1, wherein the flexible member is disposed in the first reservoir in a direction along a vertical direction.

5. An imprint apparatus, comprising:

a head including a discharge port surface on which a discharge port is formed to discharge a liquid;

a first reservoir that stores the liquid to be supplied to the head;

a flexible member, separating an inner space of the first reservoir into a first chamber that stores the liquid and a second chamber that stores an operation liquid;

a second reservoir communicating with the second chamber, the second reservoir storing the operation liquid to be supplied to the second chamber, the second reservoir being disposed in such a manner that a liquid surface of the operation liquid stored in the second reservoir is positioned below the discharge port surface;

an adjustment unit that performs adjustment in such a manner that a position of the liquid surface of the operation liquid in the second reservoir is maintained within a predetermined range in a state where the second reservoir is opened to atmosphere; and a forming unit configured to bring a surface of a substrate on which the liquid is discharged by the head and a surface of a mold on which an unevenness pattern is formed into contact with each other, so as to form a pattern corresponding to the unevenness pattern of the mold on the surface of the substrate.

6. An imprint apparatus according to claim 5, wherein the liquid includes a photocurable liquid and wherein the forming unit includes an irradiation unit that irradiates the pattern formed on the substrate so as to cure the pattern.

7. A part manufacturing method for manufacturing a part including a substrate by using an imprint apparatus including:

a head including a discharge port surface on which a discharge port is formed to discharge a liquid;

a first reservoir that stores the liquid to be supplied to the head;

a flexible member, separating an inner space of the first reservoir into a first chamber that stores the liquid and a second chamber that stores an operation liquid;

a second reservoir communicating with the second chamber, the second reservoir storing the operation liquid to be supplied to the second chamber, the second reservoir being disposed in such a manner that a liquid surface of the operation liquid stored in the second reservoir is positioned below the discharge port surface; and an adjustment unit that performs adjustment in such a manner that a position of the liquid surface of the operation liquid in the second reservoir is maintained within a predetermined range in a state where the second reservoir is opened to atmosphere, the method comprising:

applying the liquid to a surface of a substrate by the head;

bringing the surface of the substrate on which the liquid is discharged by the head and a surface of a mold on which an unevenness pattern is formed into contact with each other, so as to form a pattern corresponding to the unevenness pattern of the mold on the surface of the substrate; and treating the substrate on which the pattern is formed.

8. A liquid discharge apparatus according to claim 1, wherein the liquid in the first chamber is filled and sealed in advance, and the first reservoir is configured to be exchangeable in a case where the liquid in the first chamber has been consumed.

9. A liquid discharge apparatus according to claim 1, wherein a volume of the first chamber decreases as the liquid is discharged from the head.

10. A liquid discharge apparatus according to claim 9, wherein a volume of the second chamber increases as the liquid is discharged from the head.

11. A liquid discharge apparatus according to claim 3, wherein the liquid surface detection unit includes an upper limit position sensor that detects an upper limit position of the liquid surface of the operation liquid in the second reservoir and a lower limit position sensor that detects a lower limit position of the liquid surface of the operation liquid in the second reservoir, and wherein the pump is controlled based on a detection result of the upper limit position sensor and the lower limit position sensor.

12. A liquid discharge apparatus according to claim 4, wherein the liquid is different in density from the operation liquid.

* * * * *